US005457022A

United States Patent [19]

Hioki et al.

[11] Patent Number: 5,457,022

[45] Date of Patent: Oct. 10, 1995

[54] SILVER HALIDE PHOTOGRAPHIC MATERIAL

[75] Inventors: Takanori Hioki; Tadashi Ikeda, both of Kanagawa, Japan

[73] Assignee: Fuji Photo Film Co., Ltd., Kanagawa, Japan

[21] Appl. No.: 262,340

[22] Filed: Jun. 17, 1994

[30] Foreign Application Priority Data

Jun. 17, 1993 [JP] Japan ..... 5-169797

[51] Int. Cl.[6] ..... G03L 1/08

[52] U.S. Cl. ..... 430/612; 430/577; 430/578; 430/584; 430/604

[58] Field of Search ..... 430/612, 604, 430/594, 577, 578

[56] References Cited

U.S. PATENT DOCUMENTS 4,719,174 1/1998 Hirano et al. ..... 430/612

OTHER PUBLICATIONS

T. H. James, *The Theory of the Photographic Process, Fourth Edition,* pp. 259–268, Macmillan Publishing Co., Inc. 1977.

*Primary Examiner*—Thorl Chea

*Attorney, Agent, or Firm*—Sughrue, Mion, Zinn, Macpeak & Seas

[57] ABSTRACT

A silver halide photographic material comprising a support having thereon at least one silver halide emulsion layer, wherein at least one layer contains at least one metallocene compound.

9 Claims, No Drawings

SILVER HALIDE PHOTOGRAPHIC MATERIAL

FIELD OF THE INVENTION

The present invention relates to a high-sensitivity silver halide photographic material.

BACKGROUND OF THE INVENTION

Heretofore, provision of high-sensitivity silver halide photographic materials has been desired. In particular, provision of color-sensitized high-sensitivity silver halide photographic materials has especially been desired.

Color sensitization technology is extremely important and is indispensable for producing high-sensitivity photographic materials with excellent color reproducibility. A color sensitizer inherently has a function of absorbing light with a long wavelength range which is not substantially absorbed by silver halide photographic emulsions and of transmitting the energy of the absorbed light to the silver halide. Therefore, increasing the amount of light to be captured by a color sensitizer is advantageous for elevating the photographic sensitivity of a photographic material. Accordingly, attempts have heretofore been made to elevate the amount of light to be captured by a color sensitizer by increasing the amount of the color sensitizer to be added to the silver halide emulsion. However, if the amount of the color sensitizer to be added to the silver halide is greater than an optimum amount, the result is severe desensitization. This is generally called dye desensitization, which is a phenomenon resulting in desensitization in the light-sensitive range intrinsic to a silver halide substantially free from color absorption by a sensitizing dye. If dye desensitization of a photographic material is great, then the total sensitivity of the photographic material will be low even though the material may be heavily color-sensitized. In other words, decreasing dye desensitization causes a proportional elevation of the sensitivity of the light-absorbing range by a color sensitizer (namely, the color sensitivity of a color sensitizer itself). Therefore, the solution of the problem of dye desensitization is an important theme in color sensitization technology. In general, a sensitizing dye having a light-sensitivity in a longer wavelength range involves greater dye desensitization. These matters are described in T. H. James, *The Theory of the Photographic Process, Forth Edition,* pages 265 to 268 (published by Macmillan Publishing Co., Inc. 1977).

Methods of elevating the sensitivity of a photographic material by decreasing the dye desensitization thereof are known, as described in JP-A-47-28916, JP-A-49-46738, JP-A-54-118236 and U.S. Pat. No. 4,011,083. (The term "JP-A" as used herein means an "unexamined published Japanese patent application".) However, these proposed methods are limited to specific sensitizing dyes and the effects thereof are still unsatisfactory. The most effective means of eliminating dye desensitization presently known is a method of using bisaminostilbene compounds substituted by pyrimidine derivatives or triazine derivatives, for example, as described in JP-B-45-22189, JP-A-54-18726, JP-A-52-4822, JP-A-52-151026 and U.S. Pat. No. 2,945,762. (The term "JP-B" as used herein means an "examined Japanese patent publication".) However, the proposed compounds are only effective with a limited class of sensitizing dyes: the so-called M-band sensitizing dyes which show a gently-sloping sensitization peak in a relatively long wavelength range, such as dicarbocyanines, tricarbocyanines, rhodacyanines and merocyanines.

U.S. Pat. No. 3,695,888 discloses combination of a tricarbocyanine and an ascorbic acid to yield infrared sensitization of a photographic material; British Patent 1,255,084 discloses combination of a particular dye and an ascorbic acid to yield elevation of the minus-blue sensitivity of a photographic material; British Patent 1,064,193 discloses combination of a particular dye and an ascorbic acid to yield elevation of the sensitivity of a photographic material; and U.S. Pat. No. 3,809,561 discloses combination of a desensitizing nucleus-containing cyanine dye and a supercolor sensitizer such as an ascorbic acid.

However, the preceding technology often displays an unsatisfactory sensitizing effect of the dyes used, and even if a high sensitizing effect is attained, it often causes an increase of fog of the photographic material.

It is known that sensitizing dyes having a reduction potential of −1.25 V or more are low in a relative quantum yield of spectral sensitization as described in T. Tani et al., *Journal of the Physical Chemistry,* vol. 94, page 1298 (1990). It is proposed in the aforesaid *The Theory of the Photographic Process, Forth Edition,* pages 259–265 (1977) that super-sensitization is conducted by positive hole capture to increase the relative quantum yield of spectral sensitization. However, it is highly demanded to provide more effective supersensitizing agents.

SUMMARY OF THE INVENTION

An object of the present invention is to provide a silver halide photographic material, particularly a spectral-sensitized silver halide photographic material, which has high sensitivity and which does not tend to fog.

Another object of the present invention is to provide a silver halide photographic material which has high storage stability.

These and other objects of the present invention have been achieved by providing a silver halide photographic material, particularly preferably spectral-sensitized silver halide photographic material, comprising a support having thereon at least one silver halide emulsion layer, wherein at least one layer contains at least one metallocene compound.

DETAILED DESCRIPTION OF THE INVENTION

The metallocene is a general term for biscyclopentadienyl metal compounds [described in *Iwanami Rikagaku Jiten,* the third edition an enlarged edition, page 1335 edited by Bunichi Tamamushi et al., (published by Iwanami Shoten 1986) (written in Japanese)].

Preferably, the metallocene compound is selected from the compounds represented by the following formula (I):

(I)

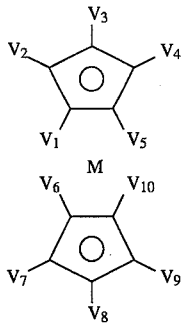

wherein M represents Fe, Ti, V, Cr, Co, Ni, Ru, Os or Pd; and $V_1$, $V_2$, $V_3$, $V_4$, $V_5$, $V_6$, $V_7$, $V_8$, $V_9$ and $V_{10}$ are the same or different and each represents a hydrogen atom or a monovalent substituent, provided that two of $V_1$, $V_2$, $V_3$, $V_4$, $V_5$, $V_6$, $V_7$, $V_8$, $V_9$ and $V_{10}$ may be combined with each other to form a ring; or two or more of the metallocene compounds may be combined together.

The compounds where M is Fe are more preferred and are called ferrocene compounds.

Now, the compounds represented by formula (I) are explained in more detail below.

$V_1$, $V_2$, $V_3$, $V_4$, $V_5$, $V_6$, $V_7$, $V_8$, $V_9$ and $V_{10}$ ( $V_1$ to $V_{10}$) are the same or different and each represents a hydrogen atom or a monovalent substituent.

Any of substituents may be used. However, the following substituents are preferred.

Examples of preferred substituents represented by $V_1$ to $V_{10}$ include an unsubstituted alkyl group (e.g., methyl, ethyl, propyl, isopropyl, butyl, isobutyl, hexyl, octyl, dodecyl, octadecyl, cyclopentyl, cyclopropyl, cyclohexyl); a substituted alkyl group (when the substituent attaching to the alkyl group is referred to as V, examples of the substituent represented by V include, but are not limited to, a carboxyl group, a sulfo group, a cyano group, a halogen atom (e.g., fluorine, chlorine, bromine, iodine), a hydroxyl group, an alkoxycarbonyl group (e.g., methoxycarbonyl, ethoxycarbonyl, benzyloxycarbonyl), an aryloxycarbonyl group (e.g., phenoxymethoxy, an alkoxy group (e.g., methoxy, ethoxy, benzyloxy, phenethyloxy), an aryloxy group having from 6 to 18 carbon atoms (e.g., phenoxy, 4-methylphenoxy, 1-napthoxy), an acyloxy group (e.g., acetyloxy, propionyloxy), an acyl group (e.g., acetyl, propionyl, benzoyl, mesyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), an aryl group (e.g., phenyl, 4-chlorophenyl, 4-methylphenyl, 1-naphthyl), a heterocyclic group (e.g., 2-pyridyl, tetrahydrofurfuryl, morpholino, 2-thiopheno), an amino group (e.g., amino, dimethylamino, anilino, diphenylamino), an alkylthio group (e.g., methylthio, ethylthio), an alkylsulfonyl group (e.g., methylsulfonyl, propylsulfonyl), an alkylsulfinyl group (e.g., methylsulfinyl), a nitro group, a phosphoric acid group, an acylamino group (e.g., acetylamino), an ammonium group (e.g., trimethylammonium, tributylammonium), a mercapto group, a hydrazino group (e.g., trimethylhydrazino), a ureido group (e.g., ureido, N,N-dimethylureido), an imido group and an unsaturated hydrocarbon group (e.g., vinyl, ethynyl, 1-cyclohexenyl); the substituent V has preferably from 0 to 18 carbon atoms, and these substituents may be further substituted by one or more of the substituents represented by V}; an unsubstituted aryl group (e.g., phenyl, 1-naththyl); a substituted aryl group (examples of the substituent include those already described above in the definition of V); an unsubstituted heterocyclic group (e. g., 2-pyridyl, 2-thiazolyl, morpholino, 2-thiopheno); a substituted heterocyclic group ( examples of the substituent include those already described above in the definition of V); and a substituent represented by V.

More specifically, the examples of preferred substituent represented by V include a substituted or unsubstituted alkyl group (e.g., methyl, ethyl, carboxymethyl, 2-carboxyethyl, 3-carboxypropyl, 4-carboxybutyl, sulfomethyl, 2-sulfoethyl, 3-sulfopropyl, 4-sulfobutyl, 3-sulfobutyl, 2-hydroxy-3-sulfopropyl, 2-cyanoethyl, 2-chloroethyl, 2-bromoethyl, 2-hydroxyethyl, 3-hydroxypropyl, hydroxymethyl, 2-hydroxyethyl, 4-hydroxybutyl, 2,4-dihydroxybutyl, 2-methoxyethyl, 2-ethoxyethyl, methoxymethyl, 2-ethoxycarbonylethyl, methoxycarbonylmethyl, 2-methoxyethyl, 2-ethoxyethyl, 2-phenoxyethyl, 2-acetyloxyethyl, 2-propionyloxyethyl, 2-acetylethyl, 3-benzoylpropyl, 2-carbamoylethyl, 2-morpholinocarbonylethyl, sulfamoylmethyl, 2-(N,N-dimethylsulfamoyl)ethyl, benzyl, 2-naphthylethyl, 2-(2-pyridyl-)ethyl, allyl, 3-aminopropyl, dimethylaminomethyl, 3-methylaminopropyl, methylthiomethyl, 2-methylsulfonylethyl, methylsulfinylmethyl, 2-acetylaminoethyl, acetylaminomethyl, trimethylammoniummethyl, 2-mercaptoethyl, 2-trimethylhydrazinoethyl, methylsulfonylcarbamoylmethyl, (2-methoxy)ethoxymethyl), a substituted or unsubstituted aryl group (e.g., phenyl, 1-naphthyl, p-chlorophenyl), a substituted or unsubstituted heterocyclic group (e.g., 2-pyridyl, 2-thiazolyl, 4-phenyl-2-thiazolyl) and a substituent represented by V (e.g., a carboxyl group, a formyl group, an acetyl group, a benzoyl group, a 3-carboxypropanoyl group, a 3-hydroxypropanoyl group, a chlorine atom, an N-phenylcarbamoyl group, an N-butylcarbamoyl group, a boric acid group, a sulfo group, a hydroxyl group, a methoxy group, a methoxycarbonyl group, an acetyloxy group, a dimethylamino group).

The substituents represented by $V_1$ to $V_{10}$ have more preferably from 1 to 18 carbon atoms.

Any two of $V_1$ to $V_{10}$ may be combined with each other to form a ring. The ring may be any of an aliphatic ring and an aromatic ring. The ring amy be substituted by one or more of the substituents represented by V.

Further, two or more compounds represented by formula (I) may be combined together.

Specific examples of the compounds represnted by formula (I) include, but are not limited to, the following compounds.

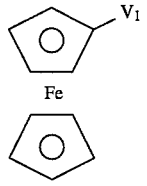

| Compound No. | $V_1$ |
|---|---|
| (I-1) | $-H$ |
| (I-2) | $-CO_2H$ |
| (I-3) | $-(CH_2)_{11}N^{\oplus}(CH_3)_3\ I^{\ominus}$ |
| (I-4) | $-CHO$ |
| (I-5) | $-SO_3H$ |

-continued
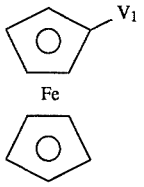
| Compound No. | $V_1$ |
|---|---|
| (I-6) | 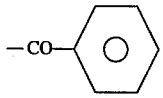 |
| (I-7) | 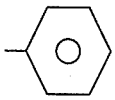 |
| (I-8) | $-B(OH)_2$ |
| (I-9) | $-(CH_2)N^{\oplus}(CH_3)_3\ I^{\ominus}$ |
| (I-10) | $-CH_2N(CH_3)_2$ |
| (I-11) | $-CO(CH_2)_2CO_2H$ |
| (I-12) | $-COCH_3$ |
| (I-13) | 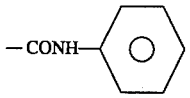 |
| (I-14) | $-CONH-(CH_2)_3CH_3$ |
| (I-15) | $-CH_2OH$ |
| (I-16) | $-Cl$ |
| (I-17) | 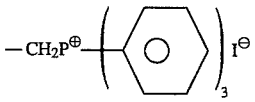 |
| (I-18) | $-CO(CH_2)_3Br$ |
| (I-19) | $-CO(CH_2)_3OH$ |
| (I-20) | $-CO(CH_2)_2OH$ |
| (I-21) | $-CH=N-OH$ |
| (I-22) | $-CH=N^{\oplus}-O^{\ominus}$ |
| (I-23) | $-CH_2SO_3{}^{\ominus}Na^{\oplus}$ |
| (I-24) | $-CH_2OCH_3$ |
| (I-25) | $-CH_2NHCOCH_3$ |
| (I-26) | $-C_2H_5$ |
| (I-27) | $-CH(OH)CH_3$ |
| (I-28) | $-C(OH)(CH_3)_2$ |
| (I-29) | $-(CH_2)_4OH$ |
| (I-30) | $-CH(OH)(CH_2)_2CH_2OH$ |
| (I-31) | 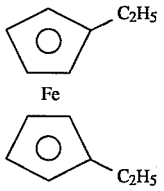 |
| (I-32) | 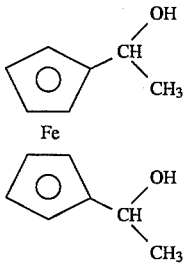 |
-continued
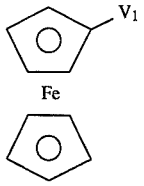
| Compound No. | $V_1$ |
|---|---|
| (I-33) | 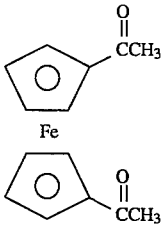 |
| (I-34) | 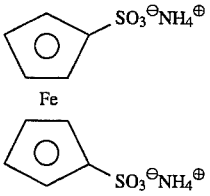 |
| (I-35) | 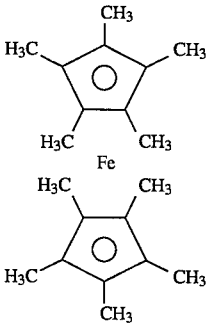 |
| (I-36) and (I-37) | 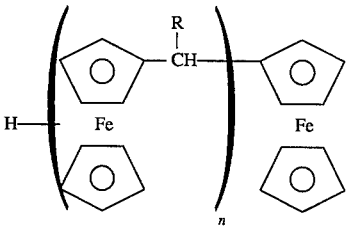 (n = 10 to 100) |
| (I-36) | R = H |
| (I-37) | 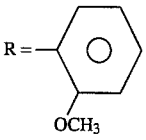 |

-continued
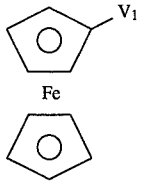
| Compound No. | $V_1$ |
|---|---|
| (I-38) | 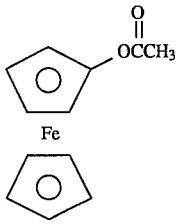  |
| (I-39) | 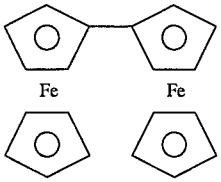  |
| (I-40) | 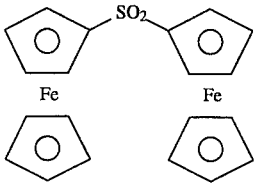  |
| (I-41) | 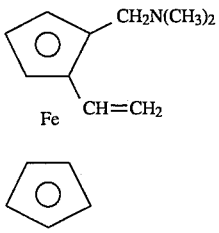  |
| (I-42) | 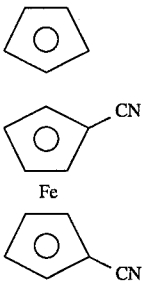  |
| (I-43) | 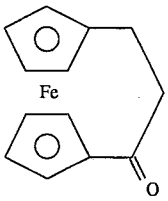  |
-continued
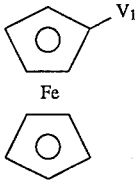
| Compound No. | $V_1$ |
|---|---|
| (I-44) | 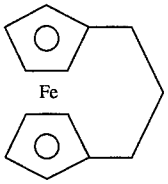  |
| (I-45) | 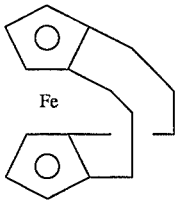  |
| (I-46) | 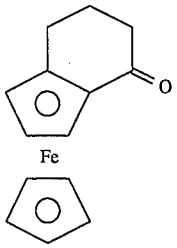  |
| (I-47) | 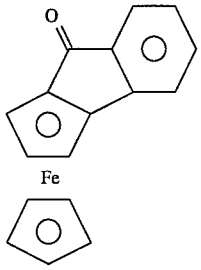  |
| (I-48) | 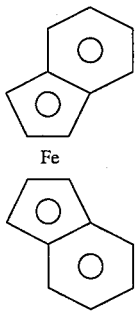  |

-continued

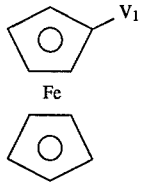

| Compound No. | $V_1$ |
|---|---|
| (I-49) | 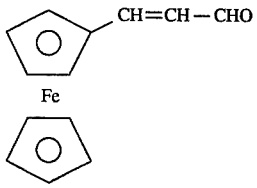  |
| (I-50) | 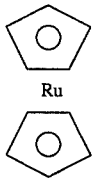  |
| (I-51) | 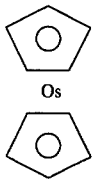  |
| (I-52) | 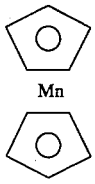  |

The metallocene compounds used in the present invention can be synthesized by referring to the method described in D. E. Bublitz et al., *Organic Reactions,* vol. 17, pp 1–154 (1969).

The metallocene compounds and the ferrocene compounds are conveniently expressed by formula (I) in the present invention. However, these compounds can be expressed by other formulae and refer to the same compounds, though these compounds are expressed by different formulae.

Expression in the present invention a)

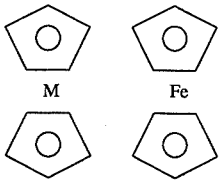

Other expressions b)

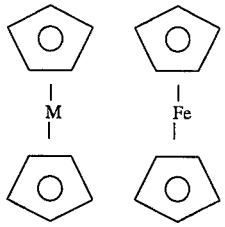

c)

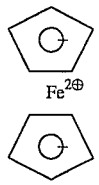

The effect obtained by the metallocene compounds of the present invention is particularly remarkable when the metallocene compounds are contained in the silver halide photographic materials spectral-sensitized by spectral sensitizing dyes.

The spectral sensitizing dyes which can be used in the present invention include any of conventional dyes such as cyanine dyes, merocyanine dyes, rhodacyanine dyes, oxonol dyes, hemicyanine dyes, benzylidene dyes and xanthene dyes. Examples of these dyes are described in T. H. James, *The Theory of the Photographic Process,* the third edition, pp. 198–228 (1966) (Macmillan Co.).

Firstly, sensitizing dyes having an oxidation potential of 0.95 ($V_{vs}$SCE) or less are preferred (the term "SCE" as used herein means a "saturated calomel electrode"). It is known that these dyes generally cause greatly dye desensitization. Secondly, sensitizing dyes having a reduction potential of −1.3 ($V_{vs}$SCE) or more are preferred. It is known that these dyes are generally low in the relative quantum yield of spectral sensitization.

The measurement of oxidation and reduction potentials was carried out by a phase discrimination second higher frequency alternating current polargraphy. The detail of the measurement is described below. Acetonitrile (spectral grade) dried in 4A-1/16 molecular sieves was used as the solvent. n-Tetrapropylammonium perchlorate (special reagent for a polargraphy) was used as the supporting electrolyte. A sample solution was prepared by dissolving from $10^{-3}$ to $10^{-5}$ mol of a sensitizing dye per liter in acetonitrile containing 0.1M supporting electrolyte. Before measurement, the sample solution was deoxidized for at least 15 minutes by using ultra-high-purity argon gas (99.999%) passed through a highly alkaline aqueous solution of pyrogallol and a tube packed with calcium chloride. A rotating platinum electrode was used as the working electrode in the measurement of oxidation potential, and a dropping mercury electrode was used as the working electrode in the measurement of reduction potential. Saturated calomel electrode (SCE) was used as a reference electrode, and platinum was used as an opposite electrode. The reference electrode was connected with the sample solution by means of a Luggin tube filled with acetonitrile containing 0.1M supporting electrolyte, and Vycor glass was used for a liquid junction part. The top of the Luggin tube was from 5 to 8 mm away from the top of the rotating platinum electrode, and the measurement was carried out at 25° C. The above measurement of oxidation and reduction potentials by the phase discrimination second higher frequency alternating current voltmmetry is described in *Journal of Imaging Science*, vol. 30, pp. 27–35 (1986). When the measurement was carried out under the above conditions, the dye (XIV-9) described hereinafter had an oxidation potential of 0.915 ($V_{vs}$SCE) and a reduction potential of −1.22 ($V_{vs}$SCE).

Sensitizing dyes represented by the following formulae (XI), (XII) and (XIII) can be particularly preferably used:

(XI)

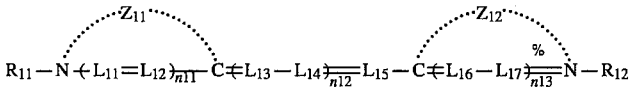

$M_{11}m_{11}$ (XII)

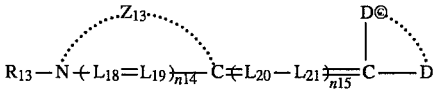

$M_{12}m_{12}$ (XIII)

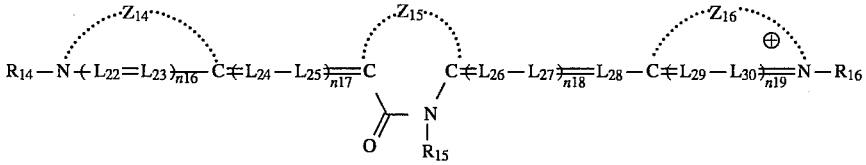

$M_{13}m_{13}$

In formulae (XI), (XII) and (XIII), $Z_{11}$, $Z_{12}$, $Z_{13}$, $Z_{14}$, $Z_{15}$ and $Z_{16}$ are the same or different each represents an atomic group necessary for forming a five-membered or six-membered nitrogen-containing heterocyclic ring.

D and D' are the same or different and each represents an atomic group necessary for forming a non-cyclic or cyclic acid nucleus.

$R_{11}$, $R_{12}$, $R_{13}$, $R_{14}$ and $R_{16}$ are the same or different and each represents a substituted or unsubstituted alkyl group.

$R_{15}$ represents a substituted or unsubstituted alkyl group, a substituted or unsubstituted aryl group or a substituted or unsubstituted heterocyclic group.

$L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$ and $L_{30}$ are the same or different and each represents a substituted or unsubstituted methine group.

$M_{11}$, $M_{12}$ and $M_{13}$ are the same or different and each represents a counter ion for neutralizing charge; $m_{11}$, $m_{12}$ and $m_{13}$ are the same or different and each represents a number of 0 or more necessary for neutralizing the molecular charge; $n_{11}$, $n_{13}$, $n_{14}$, $n_{16}$ and $n_{19}$ are the same or different and each represents 0 or 1; and $n_{12}$, $n_{15}$, $n_{17}$ and $n_{18}$ are the same or different and each represents an integer of 0 or more.

The sensitizing dyes represented by formula (XI) called cyanine dyes are more preferred.

The compounds represented by formulae (XI), (XII) and (XIII) are explained in more detail below.

Preferably, $R_{11}$, $R_{12}$, $R_{13}$, $R_{14}$ and $R_{16}$ are each an unsubstituted alkyl group having from 1 to 18 carbon atoms (for example, methyl, ethyl, propyl, butyl, pentyl, octyl, decyl, dodecyl, octadecyl) or a substituted alkyl group {for example, an alkyl group having from 1 to 18 carbon atoms substituted by one or more of substituents such as a carboxyl group, a sulfo group, a cyano group, a halogen atom (e.g., fluorine, chlorine, bromine), a hydroxyl group, an alkoxycarbonyl group having from 2 to 8 carbon atoms (e.g., methoxycarbonyl, ethoxycarbonyl, phenoxycarbonyl, benzyloxycarbonyl), an alkoxy group having from 1 to 8 carbon atoms (e.g., methoxy, ethoxy, benzyloxy, phenethyloxy), a monocyclic aryloxy group having from 6 to 10 carbon atoms (e.g., phenoxy, p-tolyloxy), an acyloxy group having 2 or 3 carbon atoms (e.g., acetyloxy, propionyloxy), an acyl group having from 2 to 8 carbon atoms (e.g., acetyl, propionyl, benzoyl, mesyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl) and an aryl group having from 6 to 10 carbon atoms (e.g., phenyl, 4-chlorophenyl, 4-methylphenyl, 1-naphthyl)}. More preferably, $R_{11}$, $R_{12}$, $R_{13}$, $R_{14}$ and $R_{16}$ are each an unsubstituted alkyl group (e.g., methyl, ethyl, n-propyl, n-butyl, n-pentyl, n-hexyl), a carboxyalkyl group (e.g., 2-carboxyethyl, carboxymethyl), a sulfoalkyl group (e.g., 2-sulfoethyl, 3-sulfopropyl, 4-sulfobutyl, 3-sulfobutyl) or a methanesulfonylcarbamoylmethyl group.

$M_{11}m_{11}$, $M_{12}m_{12}$ and $M_{13}m_{13}$ are each included in the formulae to show the presence or absence of a cation or an anion when it is necessary for neutralizing the ionic charge of the dye. Whether a certain dye is cationic, anionic or neutral depends on the auxochrome and the substituents in the dye. Typical examples of the cation include inorganic or organic ammonium ions (e.g., ammonium ion, tetraalkyl ammonium ion, pyridinium ion), an alkali metal ion (e.g., sodium ion, potassium ion) and an alkaline earth metal ion (e.g., calcium ion). The anion may be any of an inorganic ion and an organic ion. Specific examples of the anion include a halide ion (e.g., fluoride ion, chloride ion, bromide ion, iodide ion), a substituted arylsulfonate ion (e.g., p-toluenesulfonate ion, p-chlorobenzenesulfonate ion), an aryldisulfonate ion (e.g., 1,3-benzenedisulfonate ion, 1,5-naphthalenedisulfonate ion, 2,6-naphthalenedisulfonate ion), an alkylsulfate ion (e.g., methylsulfate ion, ethylsulfate ion), a sulfate ion, a thiocyanate ion, a perchlorate ion, a tetrafluoroborate ion, a picrate ion, an acetate ion and a trifluoromethanesulfonate ion.

Further, an ionic polymer or other dyes having an opposite charge to that of the sensitizing dye may be used as a counter ion for neutralizing charge. For example, a metal complex ion (e.g., bisbenzene-1,2-dithiolatonickel (III)) can be used.

Preferred ions are an ammonium ion, an iodide ion and a p-toluenesulfonate ion.

Preferably, $m_{11}$, $m_{12}$ and $m_{13}$ are each 0, 1 or 2.

Examples of the nucleus formed by $Z_{11}$, $Z_{12}$, $Z_{13}$, $Z_{14}$ or $Z_{16}$ include a thiazole nucleus [for example, a thiazole nucleus (e.g., thiazole, 4-methylthiazole, 4-phenylthiazole, 4,5-dimethylthiazole, 4,5-diphenylthiazole), a benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 6-methylthiobenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-di-methylbenzothiazole, 5,6-dimethoxybenzothiazole, 5-hydroxy-6-methylbenzothiazole, tetrahydrobenzothiazole, 4-phenylbenzothiazole), a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole)]; a thiazoline nucleus (for example, thiazoline, 4-methylthiazoline, 4-nitrothiazoline); an oxazole nucleus [for example, an oxazole nucleus (e.g., oxazole, 4-methyloxazole, 4-nitroxazole, 5-methyloxazole, 4-phenyloxazole, 4,5-diphenyloxazole, 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole), a naphthoxazole nucleus (e.g., naphtho[2,1-d ]oxazole, naphtho[1,2-d]oxazole, naphtho[2,3-d]oxazole, 5-nitronaphtho[2,1-d] oxazole)]; an oxazoline nucleus (for example, 4,4-dimethyloxazoline); a selenazole nucleus [for example, a selenazole nucleus (e.g., 4-methylselenazole, 4-nitroselenazole, 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), a naphthoselenazole nucleus (e.g., naphtho[2,1-d ]selenazole, naphtho[1,2-d ]selenazole)]; a selenazoline nucleus (for example, selenazoline, 4-methylselenazoline); a tellurazole nucleus [for example, a tellurazole nucleus (e.g., tellurazole, 4-methyltellurazole, 4-phenyltellurazole), a benzotellurazole nucleus (e.g., benzotellurazole, 5-chlorobenzotellurazole, 5-methylbenzotellurazole, 5,6-dimethylbenzotellurazole, 6-methoxybenzotellurazole), a naphthotellurazole nucleus (e.g., naphtho[2,1-d]tellurazole, naphtho[1,2-d]tellurazole)]; a tellurazoline nucleus (for example, tellurazoline, 4-methyltellurazoline); 3,3-dialkylindolenine nucleus (for example, 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, 3,3-dimethyl-5-chloroindolenine); an imidazole nucleus [for example, an imidazole nucleus (e.g., 1-alkylimidazole, 1-alkyl-4-phenylimidazole, 1-arylimidazole), a benzimidazole nucleus (e.g., 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifloromethylbenzimidazole, 1-allyl-5,6-dichorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole), a naphthoimidazole nucleus (e.g., 1-alkylnaphtho[1,2-d]imidazole, 1-arylnaphtho[1,2-d]imidazole); wherein the above-described alkyl group has preferably from 1 to 8 carbon atoms; and the alkyl group is preferably an unsubstituted alkyl group such as methyl, ethyl, propyl, isopropyl and butyl or a hydroxyalkyl group such as 2-hydroxyethyl and 3-hydroxypropyl, and more preferably a methyl group or an ethyl group; and wherein examples of the above-described aryl group include a phenyl group, a halogen-substituted phenyl group such as chlorophenyl, an alkyl-substituted phenyl group such as methylphenyl and an alkoxy-substituted phenyl group such as methoxyphenyl]; a pyridine nucleus (for example, 2-pyridine, 4-pyridine, 5-methyl-2-pyridine, 3-methyl-4-pyridine); a quinoline nucleus [for example, a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-5-quinoline, 6-chloro-4-quinoline, 5,6-dimethyl-4-quinoline), an isoquinoline nucleus (e.g., 6-nitro-l-isoquinoline, 3,4-dihydro-1-isoquinoline, 6-nitro-3-isoquinoline)]; an imidazo[4,5-b]quinoxaline nucleus (e.g., 1,3-diethylimidazo[4,5-b]quinoxaline, 6-chloro-1,3-diallylimidazo[4,5-b]quinoxaline); an oxadiazole nucleus; a thiadiazole nucleus; a tetrazole nucleus; and a pyrimidine nucleus.

Preferred examples of the nucleus formed by $Z_{11}$, $Z_{12}$, $Z_{13}$, $Z_{14}$ or $Z_{16}$ include a benzthiazole nucleus, a naphthothiazole nucleus, a benzoxazole nucleus, a naphthoxazole nucleus, a benzimidazole nucleus, a 2-quinoline nucleus and a 4-quinoline nucleus.

D and D' each represents an atomic group necessary for forming an acid nucleus and may be in any form of the acid nuclei of conventional merocyanine dyes. The term "acid nucleus" as used herein refers to the nucleus defined, for example, by T .H. James, *The Theory of the Photographic Process,* the fourth edition, page 198 (Macmillan Co. 1977). In a preferred form, examples of substituent groups which participate in the resonance of D include a carbonyl group, a cyano group, a sulfonyl group and a phenyl group. D' is the residual moiety of the atomic group necessary for forming the acid nucleus.

Specific examples thereof include those described in U.S. Pat. Nos. 3,567,719, 3,575,869, 3,804,634, 3,837,862, 4,002,480 and 4,925,777 and JP-A-3-167546.

When the acid nucleus is a non-cyclic nucleus, the terminal of the methine bond is such a group as derived from a malononitrile group, an alkanesulfonylacetonitrile group, a cyanomethylbenzofuranylketone group or a cyanomethylphenylketone group.

When the acid nucleus formed by D and D' is a cyclic nucleus, a five-membered or six-membered heterocyclic ring comprising carbon, nitrogen or chalcogen (typically, oxygen, sulfur, selenium, tellurium) atoms is formed.

Preferred examples of the acid nucleus include 2-pyrazoline-5-one, pyrazolidine-3,5-dione, imidazoline-5-one, hydantoin, 2- or 4-thiohydantoin, 2-iminoxazolidine-4-one, 2-oxazoline-5-one, 2-thioxazolidine-2,4-dione, isoxazoline-5-one, 2-thiazoline-4-one, thiazolidine-4-one, thiazolidine-2,4-dione, rhodanine, thiazolidine-2,4-dithione, isorhodanine, indane-1,3-dione, thiophene-3-one-1,1-dioxide, indoline-2-one, indoline-3-one, indazoline-3-one, 2-oxoindazolium, 3-oxoindazolium, 5,7-dioxo-6,7-dihydrothiazolo [3,2-a]pyrimidine, cyclohexane-1,3-dione, 3,4-dihydroisoquinoline 4 -one, 1,3-dioxane-4,4-dione, barbituric acid, 2-thiobarbituric acid, chroman-2,4-dione, indazoline-2-one, pyrido[1,2-a]pyrimidine-1,3-dione, pyrazolo[1,5-b] quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide and 3,3-dicyanomethine-2,3-dihydrobenzo[d]thiophene-1,1-dioxide.

The nuclei of 3-alkylrhodanine, 3-alkyl-2-thioxazolidine-2,4-dione and 3-alkyl-2-thiohydantoin are more preferred.

$R_{15}$ and the substituents attached to the nitrogen atom in the acid nucleus each represents a hydrogen atom, an alkyl group having from 1 to 18 carbon atoms (e.g., methyl, ethyl, propyl, isopropyl, butyl, isobutyl, hexyl, octyl, dodecyl, octadecyl), an aryl group having from 6 to 18 carbon atoms (e.g., phenyl, 2-naphthyl, 1-naphthyl) or a heterocyclic group having from 1 to 18 carbon atoms (e.g., 2-pyridyl, 2-thiazolyl, 2-furyl). These groups may be further substituted. Examples of the substituent include a carboxyl group, a sulfo group, a cyano group, a nitro group, a halogen atom (e.g., fluorine, chlorine, iodine, bromine), a hydroxyl group, an alkoxy group having from 1 to 8 carbon atoms (e.g., methoxy, ethoxy, benzyloxy, phenethyl), an aryloxy group having from 6 to 15 carbon atoms (e.g., phenoxy), an acyloxy group having from 2 to 8 carbon atoms (e.g., acetyloxy), an alkoxycarbonyl group having from 2 to 8 carbon atoms, an acyl group having from 2 to 8 carbon atoms, a sulfamoyl group, a carbamoyl group, an alkanesulfonylaminocarbonyl group having from 2 to 8 carbon atoms (e.g., methanesulfonylaminocarbonyl), an acylaminosulfonyl group having from 2 to 8 carbon atoms (e.g., acetylaminosulfonyl), an aryl group having from 6 to 15 carbon atoms (e.g., phenyl, 4-methylphenyl, 4-chlorophenyl, naphthyl) and a heterocyclic group having from 1 to 15 carbon atoms (e.g., pyrrolidine-2-one-1-yl, tetrahydrofurfuryl, 2-morpholino). These substituents may be further substituted by one or more of these substituents.

Of these groups, an unsubstituted alkyl group (e.g., methyl, ethyl, n-propyl, n-butyl, n-pentyl, n-hexyl), a carboxyalkyl group (e.g., carboxymethyl, 2-carboxyethyl) and a sulfoalkyl group (e.g., 2-sulfoethyl) are preferred.

The five-membered or six-membered nitrogen-containing heterocyclic ring formed by $Z_{15}$ is a ring formed by removing oxo group or thioxo group at an appropriate position from a heterocyclic ring formed by D and D', preferably a ring formed by removing a thioxo group from a rhodanine nucleus.

$L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$ and $L_{30}$ each represents a methine group or a substituted methine group [for example, a methine group substituted by one or more of a substituted or unsubstituted alkyl group (e.g., methyl, ethyl, 2-carboxyethyl), a substituted or unsubstituted aryl group (e.g., phenyl, o-carboxyphenyl), a halogen atom (e.g., chlorine, bromine), an alkoxy group (e.g., methoxy, ethoxy), an amino group (e.g., N,N-diphenylamino, N-methyl-N-phenylamino, N-methylpiperazine) and an alkylthio group (e.g., methylthio, ethylthio), or each may be combined with other methine group or an auxochrome to form a ring.

Preferably, $L_{11}$, $L_{12}$, $L_{16}$, $L_{17}$, $L_{18}$, $L_{19}$, $L_{22}$, $L_{23}$, $L_{29}$ and $L_{30}$ are each an unsubstituted methine group.

Preferably, $h_{12}$ is 0, 1, 2 or 3.

Methine dyes such as monomethine, trimethine, pentamethine and heptamethine dyes can be formed by $L_{13}$, $L_{14}$ and $L_{15}$. When $n_{12}$ is 2 or more, an $L_{13}$–$L_{14}$ unit is repeated, but the repeating units may be different.

Preferred examples of $L_{13}$, $L_{14}$ and $L_{15}$ include the following groups:

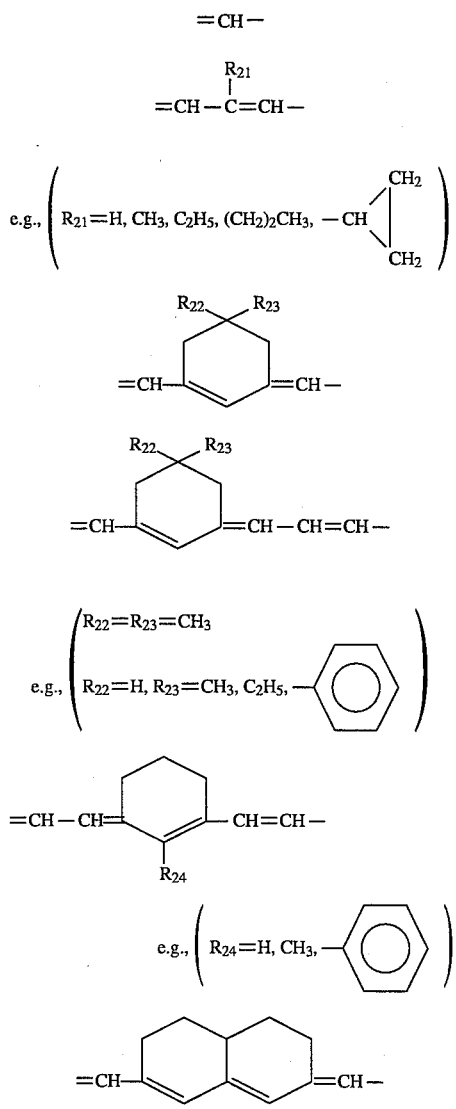

$R_{21}$, $R_{22}$, $R_{23}$, $R_{24}$ = a hydrogen atom, an alkyl group, an aryl group or a heterocyclic group Preferably, $n_{15}$ is 0, 1, 2 or 3.

Methine dyes such as zeromethine, dimethine, tetramethine and hexamethine dyes can be formed by $L_{20}$ and $L_{21}$. When $n_{15}$ is 2 or more, an $L_{20}$–$L_{21}$ unit is repeated, and the repeating units may be different.

Preferred examples of $L_{20}$ and $L_{21}$ include the following groups:

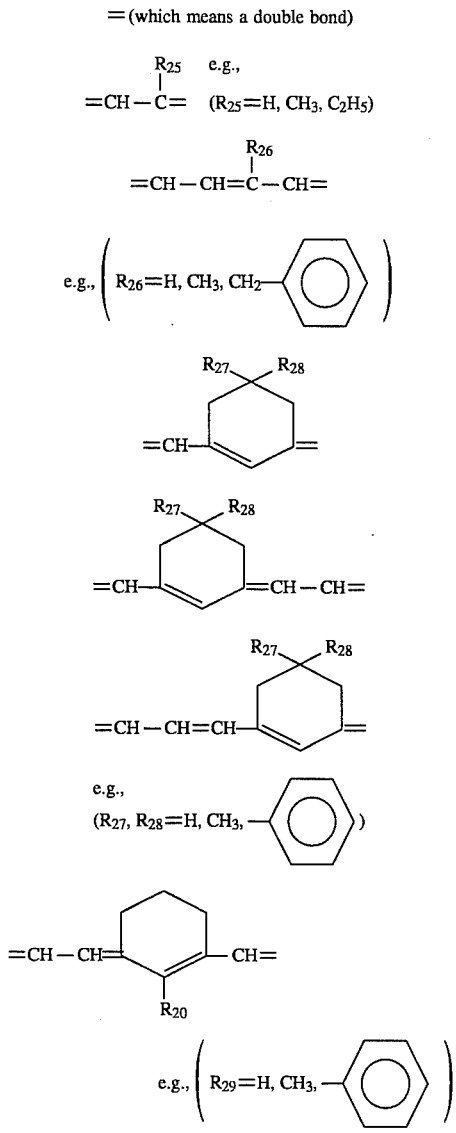

$R_{25}$, $R_{26}$, $R_{27}$, $R_{28}$, $R_{29}$ = a hydrogen atom, an alkyl group, an aryl group or a heterocyclic group Preferably, n17 is 0, 1, 2 or 3.

Methine dyes such as zeromethine, dimethine, tetramethine and hexamethine dyes can be formed by L24 and $L_{25}$. When $n_{17}$ is 2 or more, an $L_{24}$–$L_{25}$ unit is repeated, and the repeating units may be different.

Preferred examples of $L_{24}$ and $L_{25}$ are the same as those of $L_{20}$ and $L_{21}$.

Preferably, $h_{18}$ is 0, 1, 2 or 3.

Methine dyes such as monomethine, trimethine, pentamethine and heptamethine dyes can be formed by $L_{26}$, $L_{27}$ and $L_{28}$. When $n_{18}$ is 2 or more, an $L_{26}$–$L_{27}$ unit is repeated, and the repeating units may be different.

Preferred examples of $L_{26}$, $L_{27}$ and $L_{28}$ include the following groups:

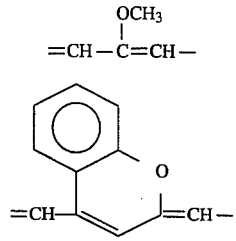

In addition to the above-described groups, the groups represented by $L_{13}$, $L_{14}$ and $L_{15}$ are also preferred.

The compound represented by formula (XI) is more preferably represented by the compound represented by the following formula (XIV):

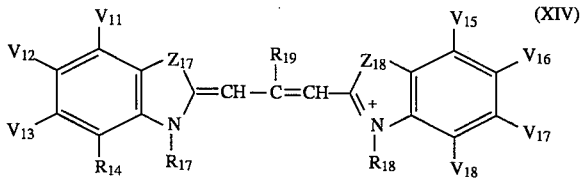

wherein $Z_{17}$ and $Z_{18}$ are the same or different and each represents a sulfur atom or a selenium atom.

$R_{17}$ and $R_{18}$ are the same or different and each represents a substituted or unsubstituted alkyl group. $R_{19}$, $V_{11}$, $V_{12}$, $V_{13}$, $V_{14}$, $V_{15}$, $V_{16}$, $V_{17}$ and $V_{18}$ are the same or different and each represents a hydrogen atom or a monovalent substituent.

$M_{14}$ represents a counter ion fro neutralizing charge; and $m_{14}$ represents a number of 0 or more necessary for neutralizing the molecular charge.

The compound represented by formula (XIV) will be explained in greater detail below.

$R_{17}$ an $R_{18}$ have the same meaning as $R_{11}$, $R_{12}$, $R_{13}$, $R_{14}$ and $R_{16}$.

Examples of te substituent represented by $R_{19}$, $V_{11}$, $V_{12}$, $V_{13}$, $V_{14}$, $V_{15}$, $V_{16}$, $V_{17}$ or $V_{18}$ include, but are not limited to, those already described above in the definition of the substituent group represented by $V_1$ to $V_{10}$.

Adjacent two of $V_{11}$, $V_{12}$, $V_{13}$, $V_{14}$, $V_{15}$, $V_{16}$, $V_{17}$ and $V_{18}$ may be combined with each other to form a condensed ring.

Examples of the condensed ring include those comprising a benzene ring and a heterocyclic ring (e.g., pyrrole, thiophene, furan, pyridine, imidazole, triazole, thiazole).

$R_{19}$ is preferably a methyl group, an ethyl group, a propyl group or a cyclopropyl group, and more preferably an ethyl group.

Preferably, $V_{11}$, $V_{12}$, $V_{14}$, $V_{15}$, $V_{16}$ and $V_{18}$ are each a hydrogen atom.

Preferably, $V_{13}$ and $V_{17}$ are each a chlorine atom, a methyl group, a methoxy group, a phenyl group or a carboxyl group.

It is also preferred that $V_{13}$ and $V_{14}$ or $V_{17}$ and $V_{18}$ are combined together to form a benzene ring.

$M_{14}m_{14}$ has the same meaning as $M_{11}m_{11}$, $M_{12}m_{12}$ and $M_{13}m_{13}$.

Typical examples of the sensitizing dyes which can be used in the present invention include, but are not limited to, the following compounds.

The sensitizing dyes are described in order of higher conception, and more preferred sensitizing dyes included in lower conception are excluded.

Examples of the sensitizing dyes represented by formula (XI) [exclusive of the dyes represented by formula (XTV)]:
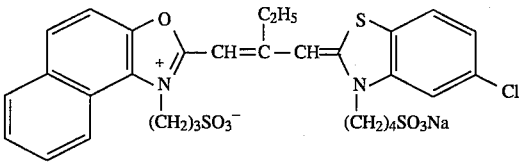
(XI-1)
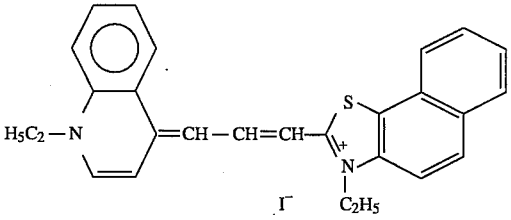
(XI-2)
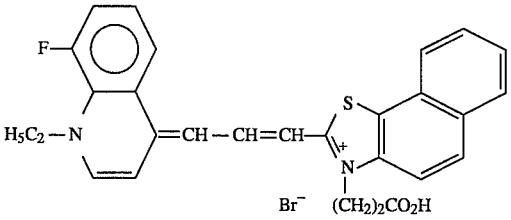
(XI-3)
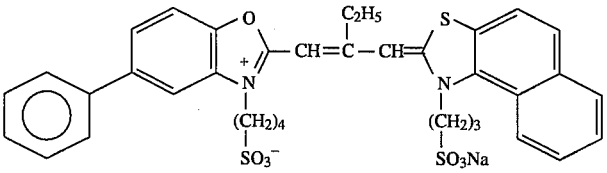
(XI-4)
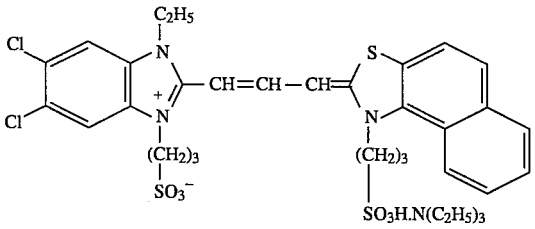
(XI-5)
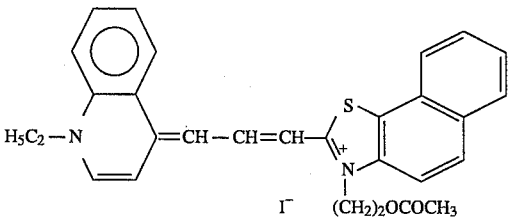
(XI-6)
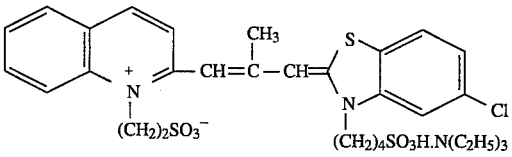
(XI-7)
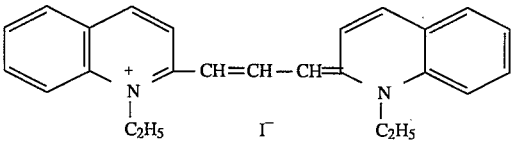
(XI-8)

-continued
(XI-9)
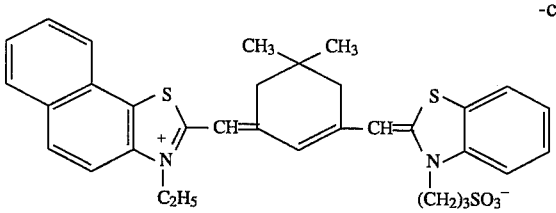
(XI-10)
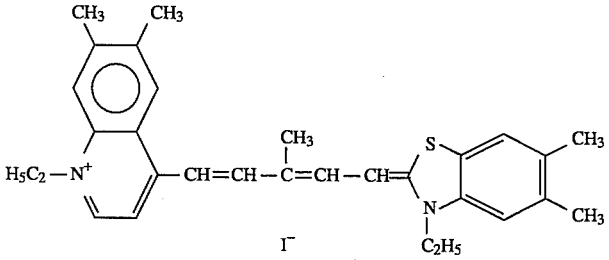
(XI-11)
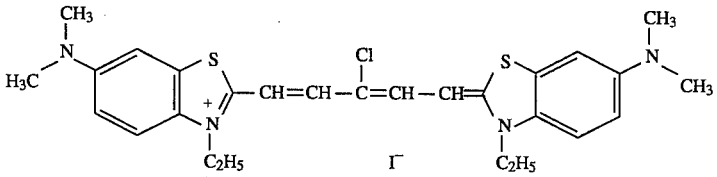
(XI-12)
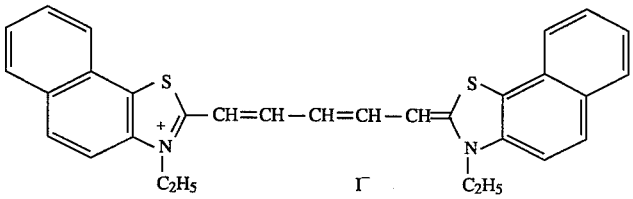
(XI-13)
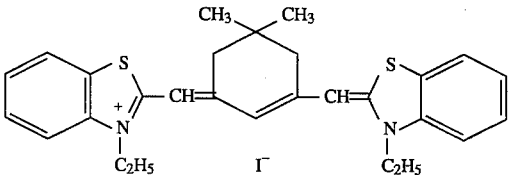
(XI-14)
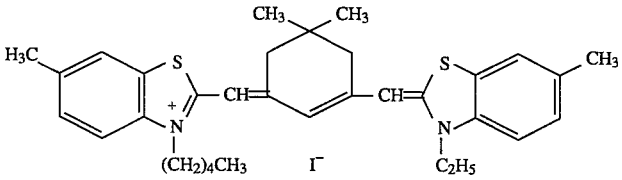
(XI-15)
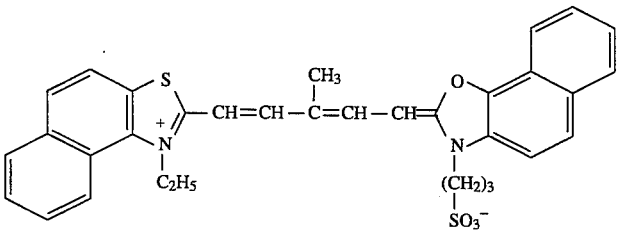

-continued
(XI-16)
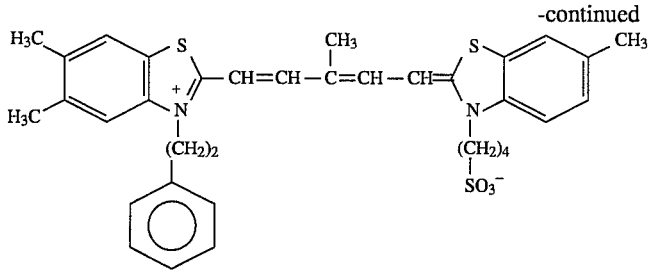
(XI-17)
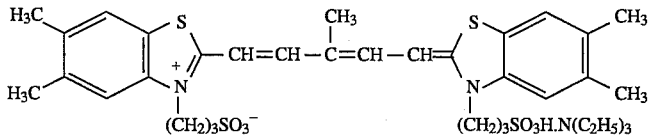
(XI-18)
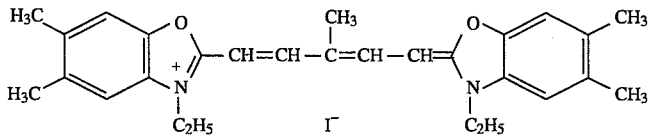
(XI-19)
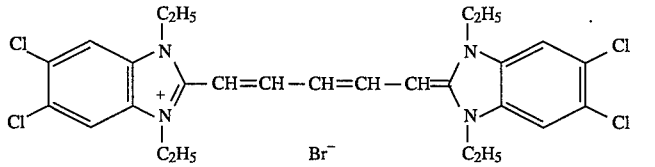
(XI-20)
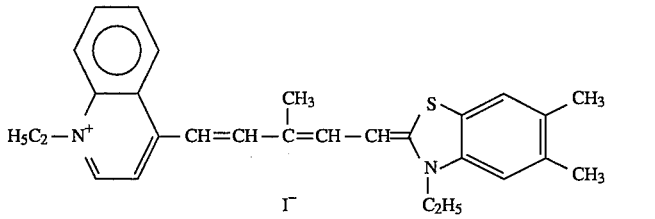
(XI-21)
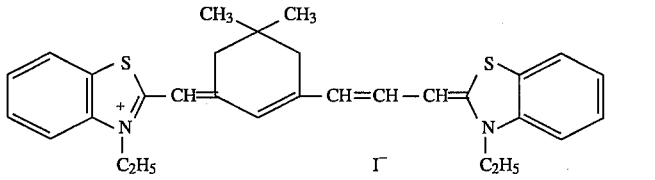
(XI-22)
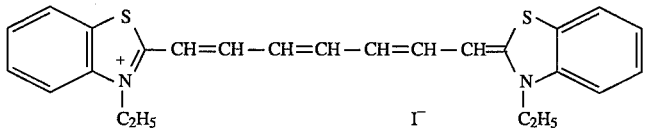
(XI-23)
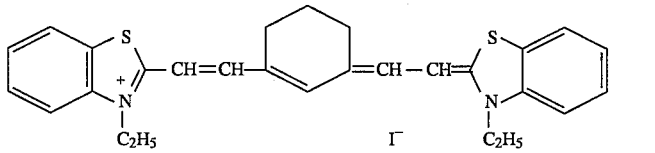
(XI-24)
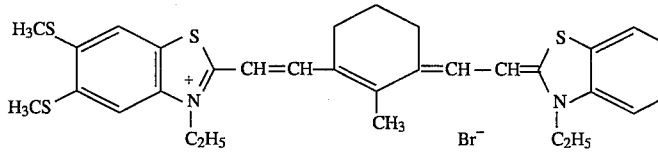

-continued
(XI-25)
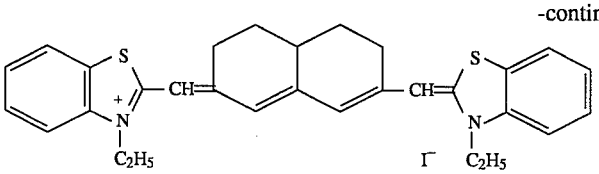
(XI-26)
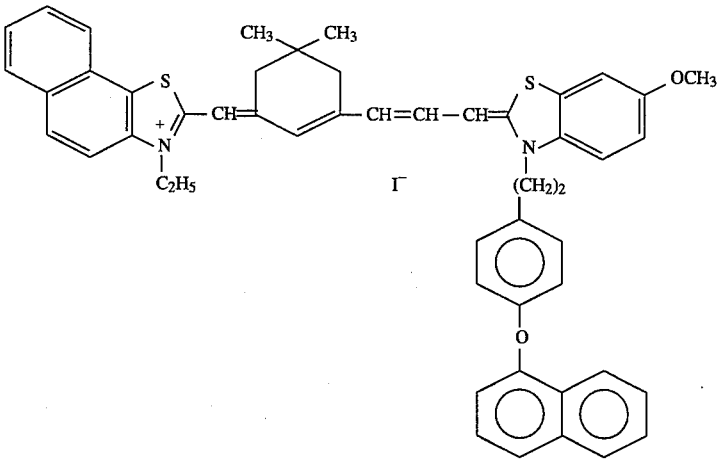
(XI-27)
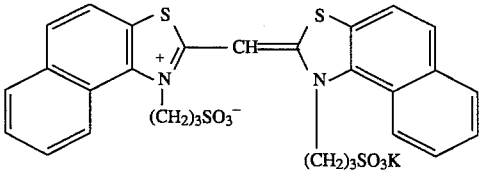
(XI-28)
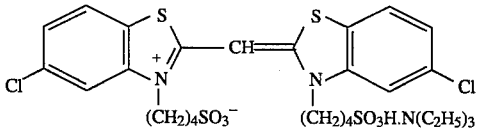
(XI-29)
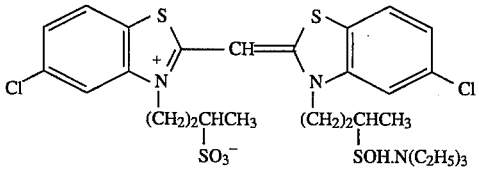
(XI-30)
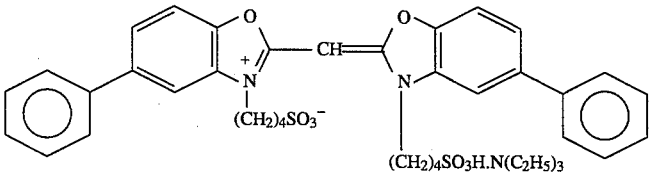
(XI-31)
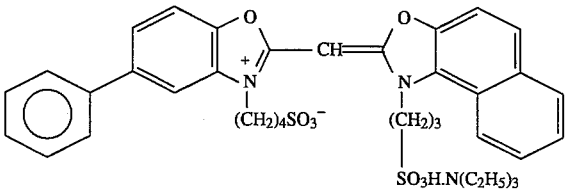

-continued
(XI-32)
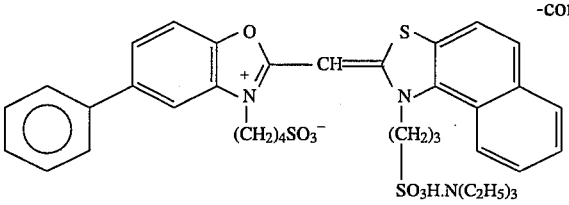
(XI-33)
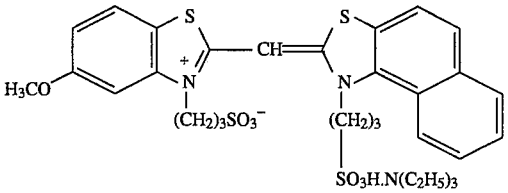
(XI-34)
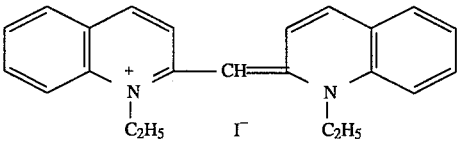
(XI-35)
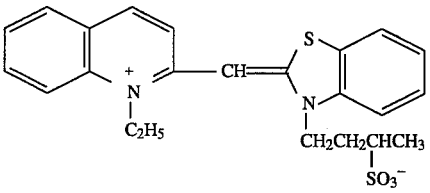
(XI-36)
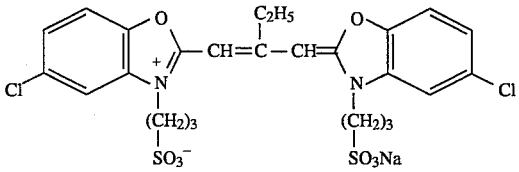
(XI-37)
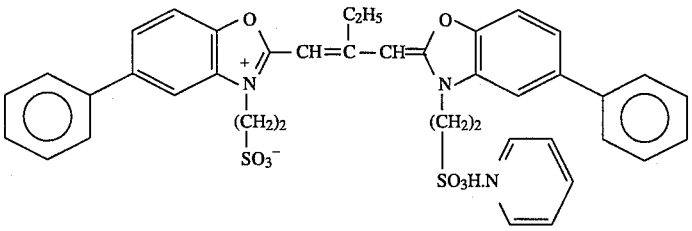
(XI-38)
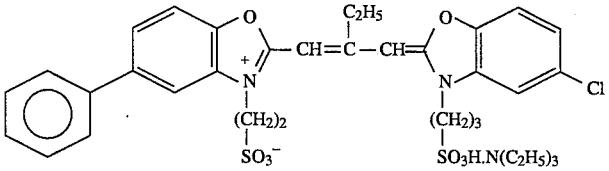
(XI-39)
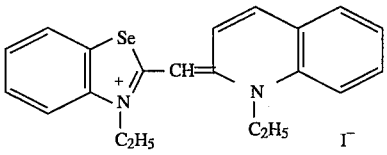
(XI-40)
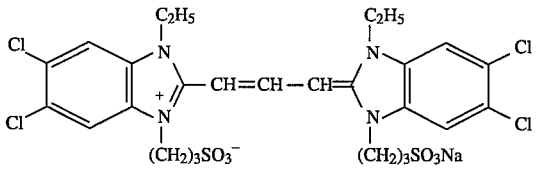

-continued
(XI-41)
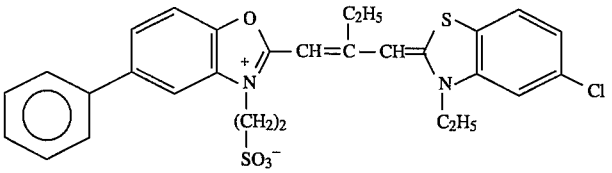
(XI-42)
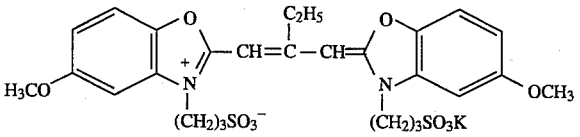
(XI-43)
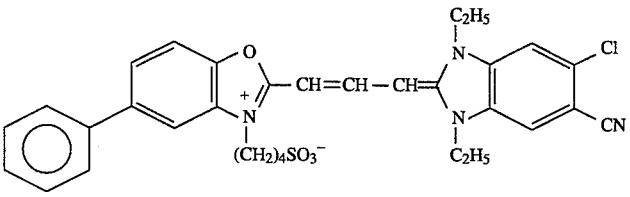
(XI-44)
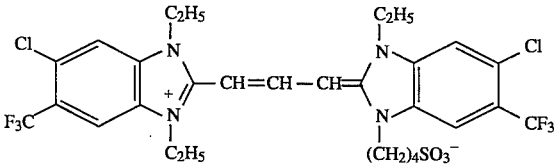
(XI-45)
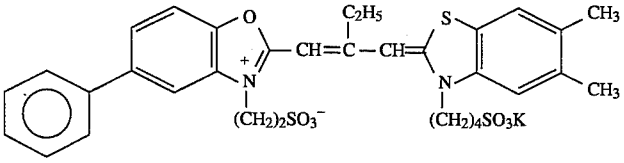
(XI-46)
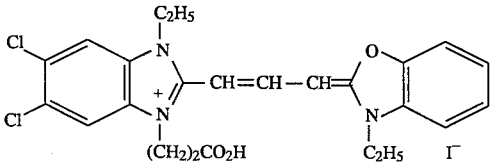
(XI-47)
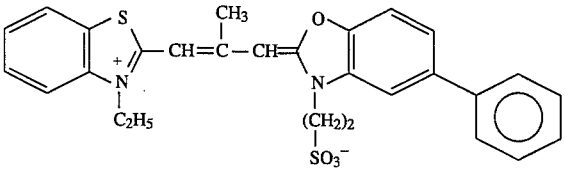
(XI-48)
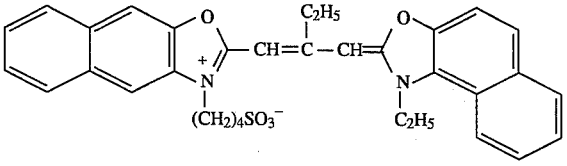
(XI-49)
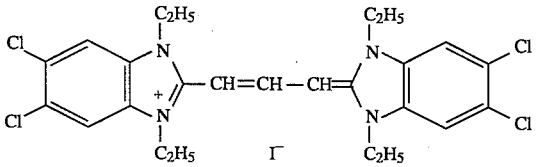

-continued
(XI-50)
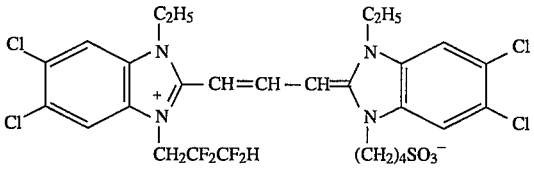
(XI-51)
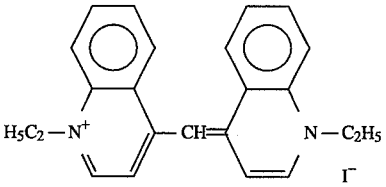
(XI-52)
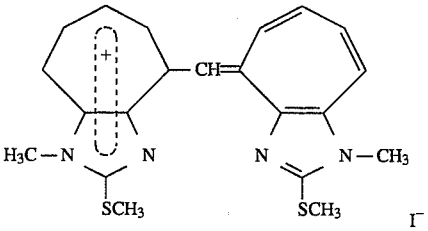
Examples of the sensitizing dyes represented by formula (XII):
(XII-1)
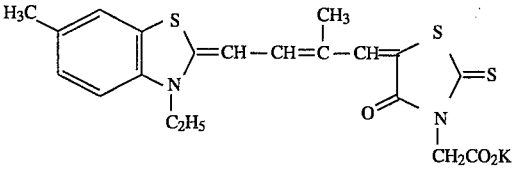
(XII-2)
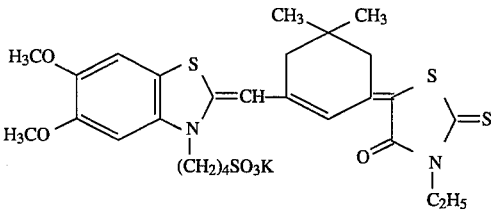
(XII-3)
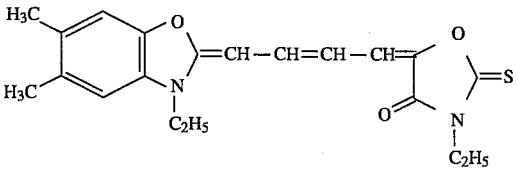
(XII-4)
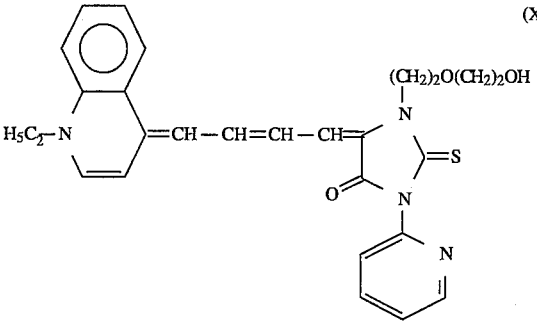
-continued
(XII-5)
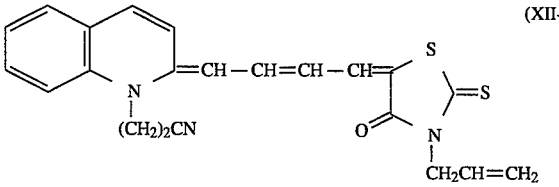
(XII-6)
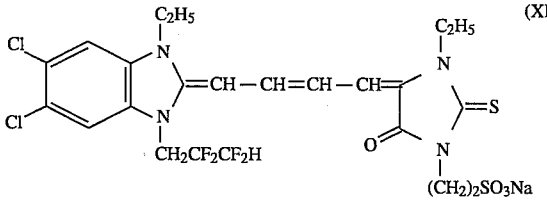
(XII-7)
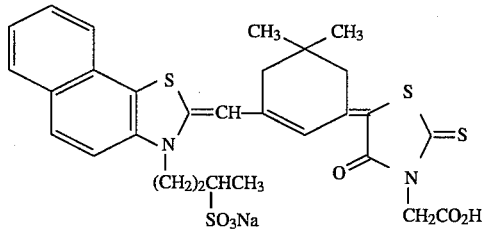
(XII-8)
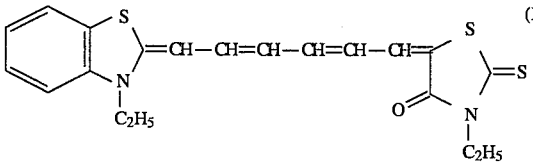

-continued
(XII-9)
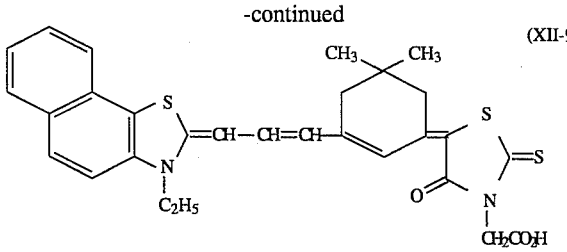
(XII-10)
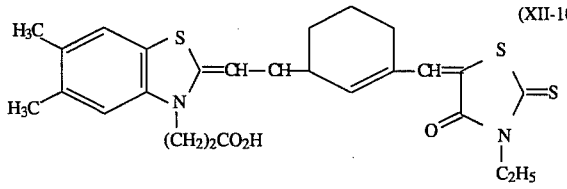
(XII-11)
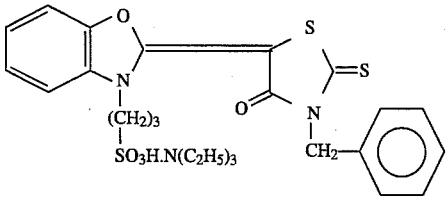
(XII-12)
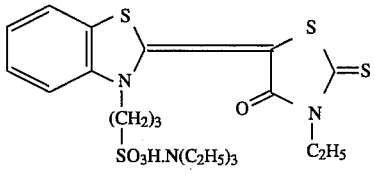
(XII-13)
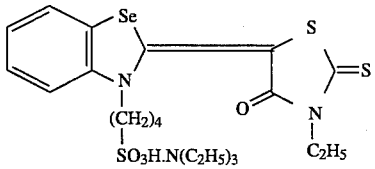
(XII-14)
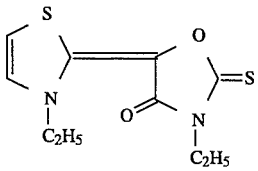
(XII-15)
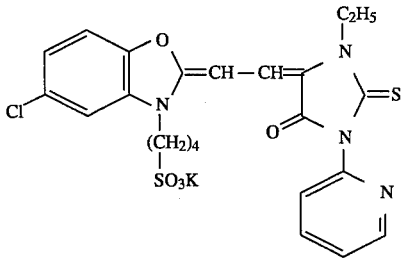
-continued
(XII-16)
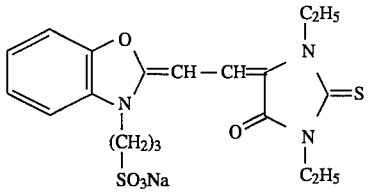
(XII-17)
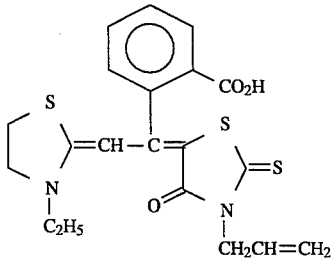
(XII-18)
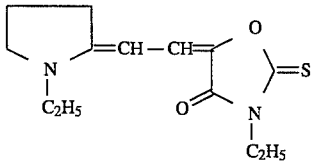
(XII-19)
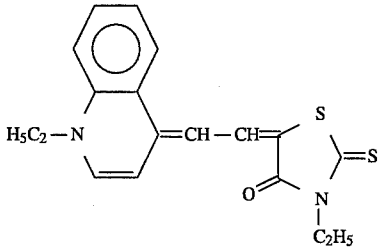
(XII-20)
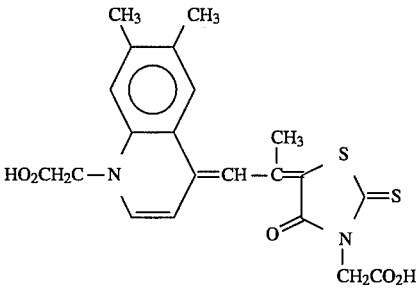
Examples of the sensitizing dyes represented by formula (XIII):
(XIII-1)
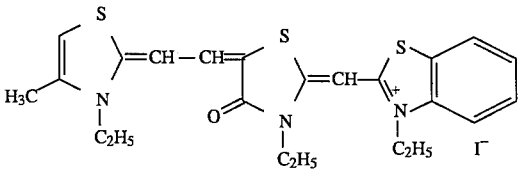

-continued
(XIII-2)
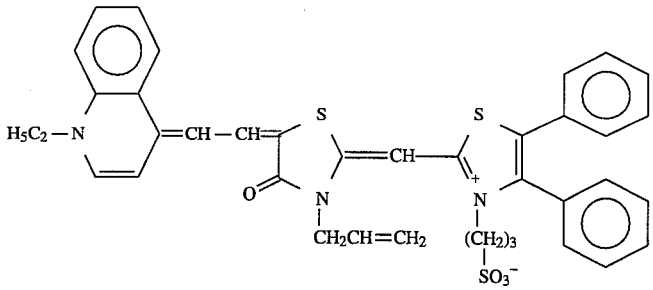
(XIII-3)
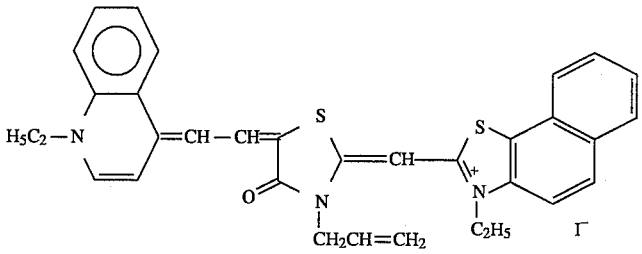
(XIII-4)
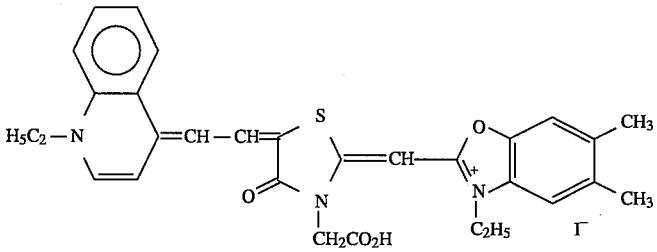
(XIII-5)
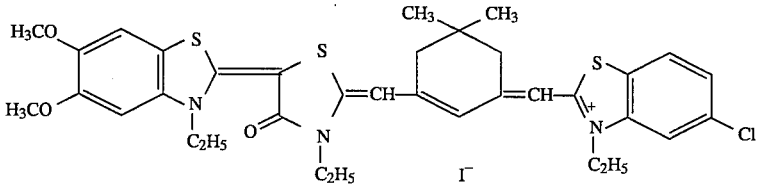
(XIII-6)
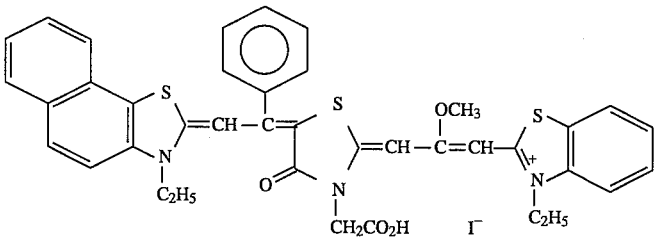
(XIII-7)
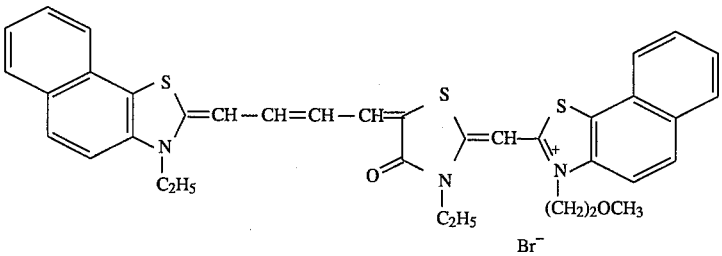

-continued
(XIII-8)
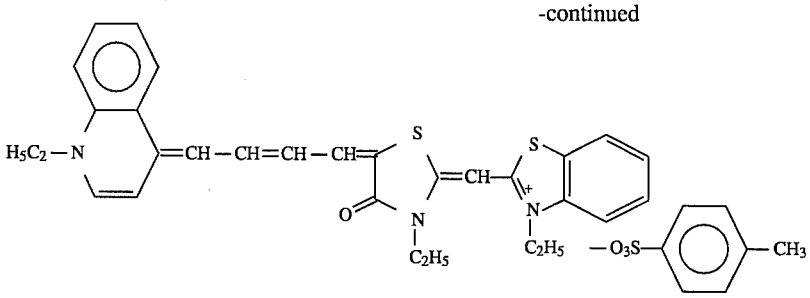
(XIII-9)
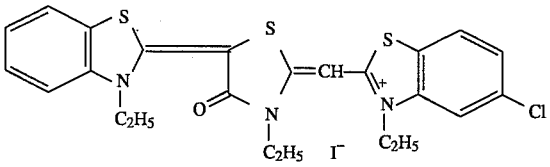
(XIII-10)
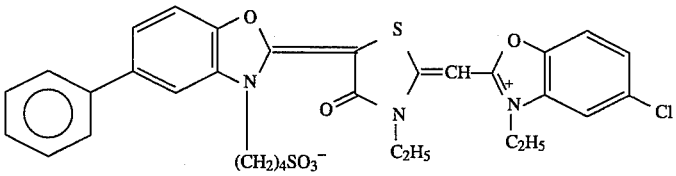
(XIII-11)
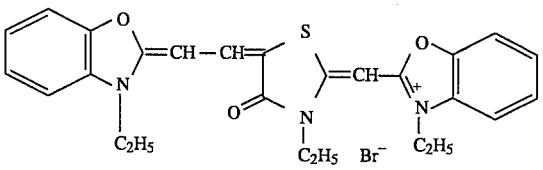
(XIII-12)
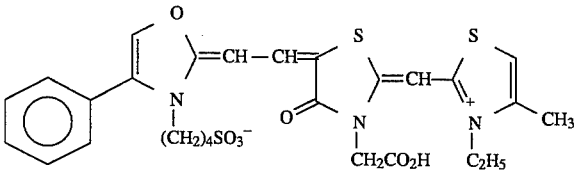
(XIII-13)
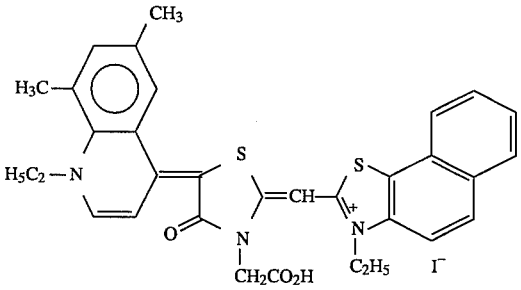
Examples of the sensitizing dyes represented by formula (XIV):
(XIV-1)
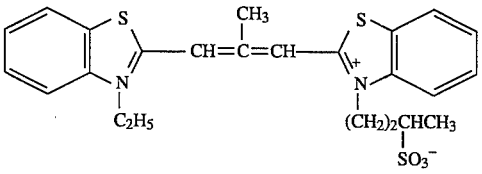

-continued
(XIV-2)
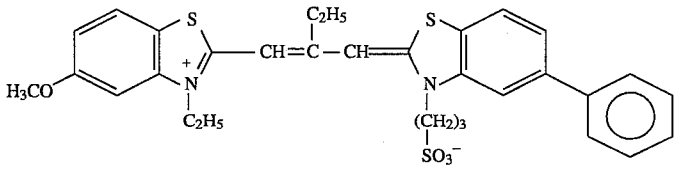
(XIV-3)
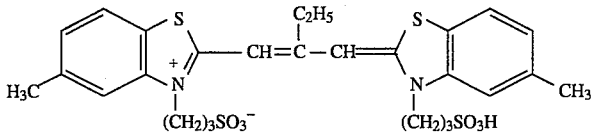
(XIV-4)
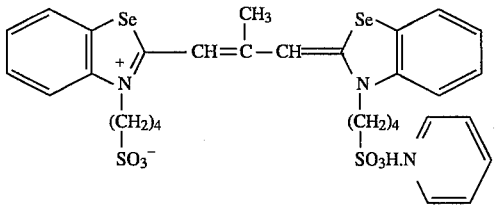
(XIV-5)
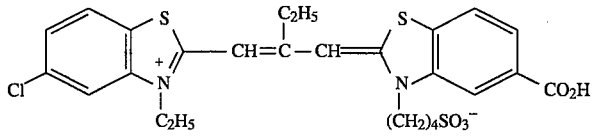
(XIV-6)
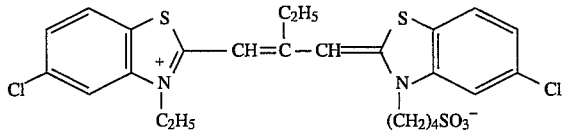
(XIV-7)
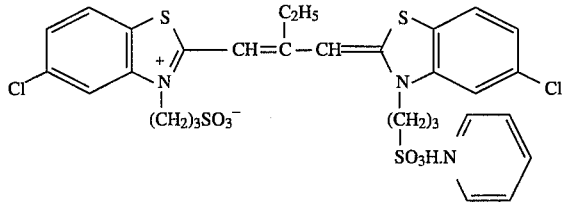
(XIV-8)
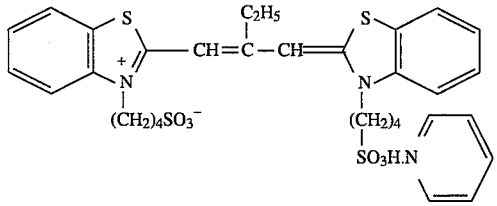
(XIV-9)
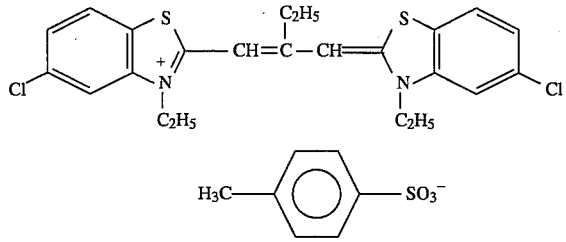

-continued
(XIV-10)
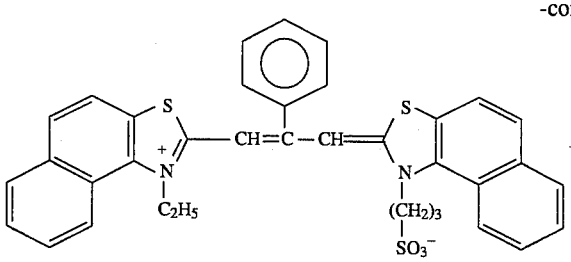
(XIV-11)
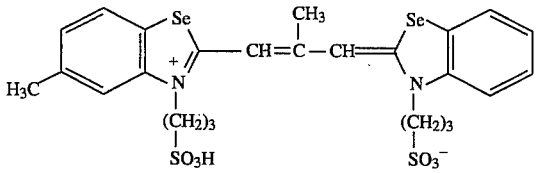
(XIV-12)
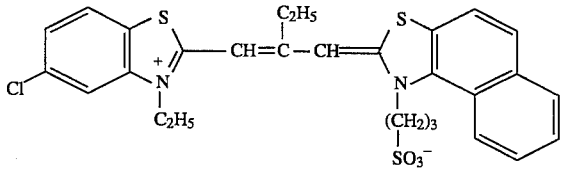
(XIV-13)
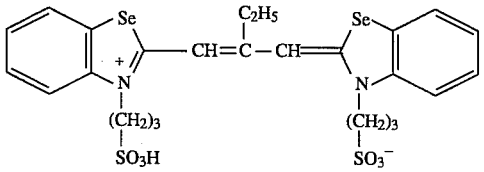
(XIV-14)
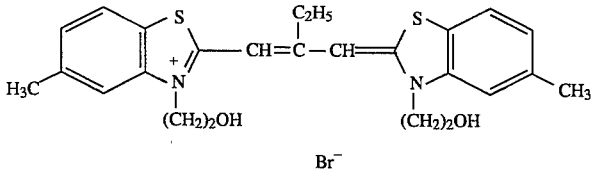
(XIV-15)
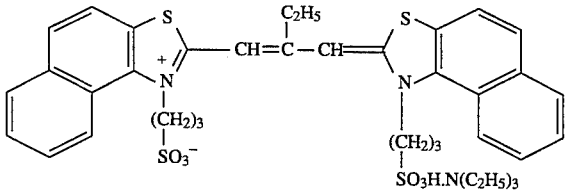
(XIV-16)
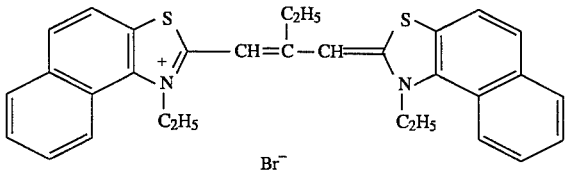
(XIV-17)
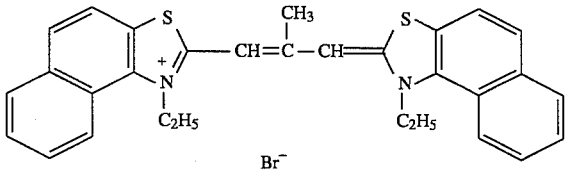

-continued (XIV-18)

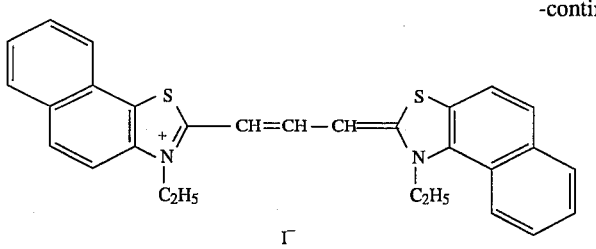

(XIV-19)

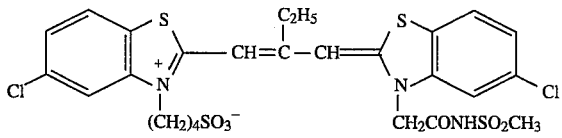

(XIV-20)

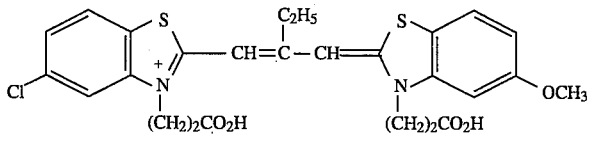

(XIV-21)

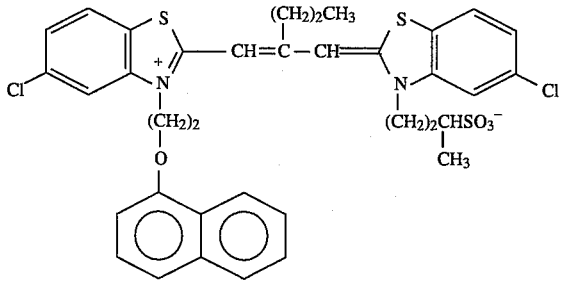

(XIV-22)

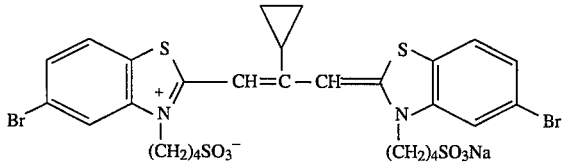

The sensitizing dyes used in the present invention can be synthesized by the methods described in F. M. Hamer, *Heterocyclic Compounds-Cyanine Dyes and Related Compounds* (John & Sons New York London 1964), D. M. Sturmer, *Heterocyclic Compounds-Special Topics in Heterocyclic Chemistry-*, chapter 18, paragraph 14, pp. 482–515 (John Wiley & Sons New York London 1977), and Rodd's Chemistry *of Carbon Compounds,* 2nd ed., vol. IV, part B (1977), chapter 15, pp. 369–422 and 2nd ed., vol. IV, part B (1985), chapter 15, pp. 267–296 (Elsvier Science Publishing Company Inc., New York).

The metallocene compounds of the present invention and the sensitizing dyes used in the present invention may be directly dispersed in the silver halide emulsions used in the present invention. Alternatively, the metallocene compounds and the sensitizing dyes may be dissolved in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide alone or a mixture thereof, and the resulting solution may be added to the emulsions.

Further, there can be used a method wherein the dye and the metallocene compound represented by formula (I) are dissolved in a volatile organic solvent, the resulting solution is dispersed in water or hydrophilic colloid, and the resulting dispersion is added to the emulsion as described in U.S. Pat. No. 3,469,987; a method wherein a water-insoluble dye and the metallocene compound represented by formula (I) are dispersed in a watersoluble solvent without dissolving the dye and the metallocene compound, and the resulting dispersion is added to the emulsion as described in JP-B-46-24185; a method wherein the dye and the metallocene compound represented by formula (I) are dissolved in an acid, and the resulting solution is added to the emulsion, or an aqueous solution of the dye and the metallocene compound is prepared in the presence of an acid or a base, and the aqueous solution is added to the emulsion as described in JP-B-44-23389, JP-B-44-27555 and JP-B-57-22091; a method wherein an aqueous solution or a colloid dispersion is prepared in the presence of a surfactant and added to the emulsion as described in U.S. Pat. Nos. 3,822,135 and 4,006,026; a method wherein the dye and the metallocene compound represented by (I) are directly dispersed in hydrophilic colloid, and the resulting dispersion is added to the emulsion as described in JP-A-58-105141; and a method wherein the dye and the metallocene compound represented by formula (I) are dissolved by using a compound to be red-shifted, and the resulting solution is added to the emulsion as described in JP-A-51-74624.

Furthermore, ultrasonic wave can be used to dissolve the dye and the metallocene compound represented by formula (I).

The sensitizing dyes used in the present invention and the metallocene compounds may be added to the emulsions during the preparation of the emulsions at any stage conventionally considered to be advantageous. For example, they may be added during the formation of silver halide grains and/or before desalting, or during desalting and/or before chemical sensitization after desalting as described in U.S. Pat. Nos. 2,735,766, 3,628,960, 4,183,756 and 4,225,666, JP-A-58-184142 and JP-A-60-196749. They may be added immediately before or during chemical ripening or at any stage before coating after chemical ripening as described in JP-A-58-113920. Further, the same compound alone or a combination of compounds having different structures may be divided into two or more portions and added. For example, a part thereof is added during the formation of the grains, and the remainder is added during or after chemical ripening. A part thereof is added before chemical ripening, and the remainder is added after completion of chemical ripening. The types of compounds to be divided or the combinations of compounds may be changed and added.

The amounts of the sensitizing dyes to be added vary depending on the form and size of the silver halide grains, but are preferably used in an amount of from $4\times10^{-8}$ to $8\times10^{-2}$ mol per mol of silver halide.

The metallocene compounds of the present invention may be added before or after the addition of the sensitizing dyes and are used in an amount of preferably from $1\times10^{-6}$ to $5\times10^{-5}$ mol, more preferably from $1\times10^{-5}$ to $2\times10^{-2}$ mol, and most preferably from $1\times10^{-4}$ to $1.6\times10^{-2}$ mol, per mol of silver halide in the silver halide emulsion.

The ratio (by mol) of the sensitizing dye to the metallocene compound is not particularly limited. However, the ratio of the sensitizing dye/the metallocene compound is preferably from 100/1 to 1/1000, more preferably from 10/1 to 1/100.

The silver halide used in the present invention may be any of silver chloride, silver bromide, silver iodide, silver chlorobromide, silver chloroiodide, silver chloroiodobromide and silver iodobromide. The silver halide emulsions used in the present invention may contain one kind of silver halide grains or a mixture of two or more kinds of silver halide grains. Silver halide grains may be different in phase between the interior of the grain and the surface layer thereof. The silver halide grains may have a polyphase structure having a joint structure. The silver halide grains may have localized phases on the surface of the grain. The silver halide grains may comprise a uniform phase throughout the entire grain or may be in the mixed form of a uniform phase and other phases.

The silver halide grains used in the present invention may be a monodisperse type or a polydisperse type, and may have a regular crystal form such as a cubic, octahedral or tetradecahedral form, an irregular crystal form or a composite form of these crystal forms. There may be used tabular emulsions comprising grains having such a grain size distribution that AgX grains having an aspect ratio (a ratio of the diameter of the grain in terms of the diameter of the corresponding circle to the thickness of the grain) of 3 or more account for 50% or more of the entire projected areas of the entire grains. An aspect ratio of from 5 to 8 is more preferred. Emulsions may comprise a mixture of grains having various crystal forms. The emulsions may be a surface latent image type wherein a latent image is predominantly formed on the surface of the grain or an internal latent image type wherein a latent image is predominantly formed in the interior of the grain.

The photographic emulsions used in the present invention can be prepared by the methods described in the literature such as P. Glafkides, *Chemie et Physique Photographique* (Paul Montel 1967), G. F. Daffin, *Photographic Emulsion Chemistry* (Focal Press 1966), V. L. Zelikman et al., *Making and Coating Photographic Emulsion* (Focal Press 1964), F. H. Claes et al., *The Journal of Photographic Science,* (21) pages 39 to 50 (1973) and (21) pages 85–92 (1973) and in the patent specifications of JP-B-55-42737, U.S. Pat. Nos. 4,400,463 and 4,801,523, JP-A-62-218959, JP-A-63-213836, JP-A-63-218938 and JP-A-2-32. Namely, any of the acid process, the neutral process and the ammonia process can be used. A soluble silver salt and a soluble halide can be reacted by the single jet process, the double jet process or a combination thereof. A method wherein grains are formed in the presence of an excess of silver (called a reverse mixing method) can be used. As a type of the double jet process, a method wherein the pAg in a liquid phase in which silver halide is formed is kept constant, that is, the controlled double jet process can also be used. According to this process, a silver halide emulsion wherein the grain form is regular and the grain size is nearly uniform can be obtained.

Further, the present invention can use emulsions prepared by a conversion method including the step of converting silver halide already formed during the course of the formation of silver halide grains and emulsions prepared by a conversion method including the step of converting silver halide grains after completion of the formation of the silver halide grains.

Solvents for silver halide may be used during the preparation of the silver halide grains used in the present invention. Examples of the solvents for silver halide which are often used include thioether compounds (e.g., those described in U.S. Pat. Nos. 3,271,157, 3,574,628, 3,704,130 and 4,276,347), thione compounds and thiourea compounds (e.g., those described in JP-A-53-144319, JP-A-53-82408, JP-A-55-77737) and amine compounds (e.g., those described in JP-A-54-100717). Further, ammonia can be used in an amount which does not provide any adverse effect.

It is preferred that the addition rates of the silver salt solution (e.g., an aqueous solution of silver nitrate) and the halide solution (e.g., an aqueous solution of sodium chloride) and the amounts and concentrations thereof are increased with time to expedite the growth of the grains during the preparation of the silver halide grains. The methods are described in, for example, British Patent 1,335,925, U.S. Pat. Nos. 3,672,900, 3,650,757 and 4,242,445, JP-A-55-142329, JP-A-55-158124, JP-A-55-113927, JP-A-58-113928, JP-A-58-111934 and JP-A-58-111936.

A cadmium salt, a zinc salt, a potassium salt, a rhenium salt, a ruthenium salt, an iridium salt or a complex salt thereof, a rhodium salt or a complex salt thereof, or an iron salt or a complex salt thereof may be allowed to coexist during the course of the formation of the silver halide grains or during the physical ripening thereof. Particularly, the use of a rhenium salt, an iridium salt, a rhodium salt or an iron salt is preferred.

The amounts of these salts to be added may be arbitrarily determined. However, the iridium salt (e.g., $Na_3IrCl_6$, $Na_2IrCl_6$, $Na_3Ir(CN)_6$) is used in an amount of preferably from $1\times10^{-8}$ to $1\times10^{-5}$ mol per mol of silver. The rhodium salt (e.g., $RhCl_3$, $K_3Rh(CN)_6$) is used in an amount of preferably from $1\times10^{-8}$ to $1\times10^{-5}$ mol per mol of silver.

The silver halide emulsions used in the present invention may be used without chemical sensitization. If desired, the silver halide emulsions may be chemical-sensitized.

Examples of chemical sensitization methods include gold sensitization method using gold compounds (described in, for example, U.S. Pat. Nos. 2,448,060 and 3,320,069), sensitization method using metal such as iridium, platinum, rhodium or palladium (described in, for example, U.S. Pat. Nos. 2,448,060, 2,566,246 and 2,566,263), sulfur sensitization method using sulfur-containing compounds (described in, for example, U.S. Pat. No. 2,222,264), selenium sensitization method using selenium compounds and reduction sensitization method using tin salts, thiourea dioxide or polyamides (described in, for example, U.S. Pat. Nos. 2,487,850, 2,518,698 and 2,521,925). These sensitization methods may be used either alone or in a combination of two or more of them.

It is preferred that the silver halide emulsions used in the present invention are subjected to gold sensitization, sulfur sensitization or a combination thereof. Gold sensitizing agents and sulfur sensitizing agents are used in an amount of preferably from $1\times10^{-7}$ to $1\times10^{-2}$ mol, more preferably $5\times10^{-6}$ to $1\times10^{-3}$ mol, per mol of silver. When gold sensitization and sulfur sensitization are carried out in combination, the gold sensitizing agent and the sulfur sensitizing agent are used in a ratio by mol of preferably from 1:3 to 3:1, more preferably from 1:2 to 2:1.

In the present invention, chemical sensitization is carried out at a temperature of from 30° to 90° C. The pH thereof is from 4.5 to 9.0, preferably from 5.0 to 7.0. The time of chemical sensitization varies depending on the temperature, the pH and the types and amounts of the chemical sensitizing agents used, and may be over a period of several minutes to several hours, but is usually from 10 to 200 minutes.

It is preferred in the present invention that the sensitizing dyes are used together with water-soluble iodides such as typically potassium iodide, water-soluble bromides such as typically potassium bromide and water-soluble thiocyanates such as typically potassium thiocyanate to enhance adsorptivity to silver halide or the formation of J-aggregate or to obtain more higher spectral sensitivity. When the silver chloride or silver chlorobromide having a high silver chloride content is used, the effects obtained by using water-soluble bromides or water-soluble thiocyanates are particularly remarkable.

High silver chloride emulsions having a silver chloride content of 50 mol % or more are preferred to conduct ultra-high rapid processing where development time is 30 seconds or less. For this purpose, it is preferred that the concentration of iodide ion including the above-described water-soluble iodides is 0.05 mol % or less because the iodide ion possesses a high development inhibiting effect.

High silver chloride emulsions having a silver chloride content of 80 mol % or more are more preferred to prepare ultra-high rapid processable silver halide photographic materials. When the emulsions are to be prepared, the use of the sensitizing dyes together with the water-soluble bromides and/or the water-soluble thiocyanates is preferred as described above because the formation of J-aggregate can be enhanced and higher spectral sensitivity can be obtained. The amounts of these compounds to be added are preferably from 0.03 to 3 mol %, particularly preferably from 0.08 to 1 mol %, per mol of silver.

High silver chloride grains having a silver chloride content of 80 mol % or more have such a characteristic that when the grains are spectral-sensitized to infrared region, high sensitivity can be obtained, and a latent image having excellent stability can be obtained. High silver chloride grains having localized phases described in JP-A-2-248945 are more preferred. It is preferred that the localized phases have a silver bromide content of 15 mol % or more as described in the above patent specification. A silver bromide content of from 20 to 60 mol % is more preferred. It is most preferred that the silver bromide content is from 30 to 50 mol %, and the remainder is silver chloride. The localized phases may exist on the surface of the grain or in the interior thereof, or may be distributed so that a portion of the localized phases exists in the interior of the grain, a portion thereof exists on the surface thereof, and a portion thereof exists in the subsurface thereof. The localized phases may exist in a laminar structure so that the silver halide grain is surrounded with the localized phases in the interior of the grain or on the surface thereof. The localized phases may exist in a discontinuous independent form. In a preferred embodiment of the arrangement of the localized phase having a higher silver bromide content than that of the circumference, the localized phase having a silver bromide content of more than 15 mol % is formed on the surface of the silver halide grain by epitaxial growth.

The silver bromide content of the localized phase can be analyzed by X-ray diffractometry (e.g., described in *New Experimental Chemical Lecture* 6, "Structural Analysis", edited by Chemical Society of Japan, published by Maruzen, Japan) or XPS method (e.g., *Surface Analysis, IPA, Application of Auger Electron Photoelectron Spectroscopy,* published by Kodan-sha, Japan). The localized phases are preferably from 0.1 to 20%, more preferably 0.5 to 7%, of silver based on the total amount of silver in the silver halide grain.

The interface between the localized phase having a high silver bromide content and other phase may be a clear phase boundary or may have a short transition zone where the halogen composition is gradually changed.

The localized phase having a high silver bromide content can be formed by various methods. For example, the localized phases can be formed by reacting a soluble silver salt with a soluble halide according to the single jet process or the double jet process or by a conversion method including a stage where an already formed silver halide is converted to silver halide having a smaller solubility product. Alternatively, the localized phases can be formed by adding fine silver bromide grains to silver halide grains to recrystallize the fine silver bromide grains on the surfaces of the silver halide grains.

The silver halide emulsions prepared according to the present invention can be applied to any of color photographic materials and black and white photographic materials.

Examples of the color photographic materials include color paper, color films for photographing and reversal color films. Examples of the black and white photographic materials include X-ray films, general-purpose films for photographing and films for printing photographic materials.

Additives described in *Research Disclosure* vol. 176, No. 17643 (RD 17643) and ibid. vol. 187, No. 18716 (RD 18716) can be applied to the emulsions of the photographic materials used in the present invention without particular limitation.

Places where additives are described in RD 17643 and RD 18716 are listed in Table 1 below.

TABLE 1

| Additive | RD 17643 | RD18716 |
|---|---|---|
| 1 Chemical Sensitizing Agent | page 23 | right column of page 648 |
| 2 Sensitivity Increaser | — | right column of page 648 |
| 3 Spectral Sensitizing Agent, Supersensitizing Agent | pages 23–24 | right column of page 648 to right column of page 649 |
| 4 Brightener | page 24 | |
| 5 Anti-fogging Agent, Stabilizer | pages 24–25 | right column of page 649 |
| 6 Light Absorber, Filter Dye, UV Absorber | pages 25–26 | right column of page 649 to left column of page 650 |
| 7 Anti-staining Agent | right column of page 25 | left column to right column of page 650 |
| 8 Dye Image Stabilizer | page 25 | |
| 9 Hardening Agent | page 26 | left column of page 651 |
| 10 Binder | page 26 | left column of page 651 |
| 11 Plasticizer, Lubricant | page 27 | right column of page 650 |
| 12 Coating Aid, Surfactant | pages 26–27 | right column of page 650 |
| 13 Antistatic Agent | page 27 | right column of page 650 |

Dyes other than sensitizing dye suitable for use in the photographic material of the present invention will be described in detail below.

The photographic material of the present invention may contain colloidal silver and other dyes for the purpose of anti-irradiation and anti-halation, and especially for separation of the spectral sensitivity distribution of each light-sensitive layer and for ensuring safety to a safelight. Such dyes include, for example, oxonole dyes having pyrazolone nuclei, barbituric nuclei or barbituric acid nuclei, such as those described in U.S. Pat. Nos. 506,385, 1,177,429, 1,131,884, 1,338,799, 1,385,371, 1,467,214, 1,438,102 and 1,553,516, JP-A-48-85130, JP-A-49-114420, JP-A-52-117123, JP-A-55-161233, JP-A-59-111640, JP-B-39-22069, JP-B-43-13168, JP-B-62-273527, and U.S. Pat. Nos. 3,247,127, 3,469,985 and 4,078,933; other oxonole dyes, such as those described in U.S. Pat. Nos. 2,533,472 and 3,379,533, British Patent 1,278,621, JP-A-1-134447, and JP-A-1-183652; azo dyes such as those described in British Patents 575,691, 680,631, 599,623, 786,907, 907,125 and 1,045,609, U.S. Pat. No. 4,255,326, and JP-A-59-211043; azomethine dyes such as those described in JP-A-50-100116, JP-A-54-118247 and British Patents 2,014,598 and 750,031; anthraquinone dyes such as those described in U.S. Pat. No. 2,865,752; arylidene dyes such as those described in U.S. Pat. Nos. 2,538,009, 2,688,541 and 2,538,008, British Patents 584,609 and 1,210,252, JP-A-50-40625, JP-A-51-3623, JP-A-51-10927, JP-A-54-118247, JP-B-48-3286 and JP-B-59-37303; styryl dyes such as those described in JP-B-28-3082, JP-B-44-16594, and JP-B-59-28898; triarylmethane dyes such as those described in British Patents 446,538, and 1,335,422, and JP-A-59-228250; merocyanine dyes such as those described in British Patents 1,075,653, 1,153,341, 1,284,730, 1,475,228 and 1,542,807; and cyanine dyes such as those described in U.S. Pat. Nos. 2,843,486 and 3,294,539, and JP-A-1-291247.

For the purpose of preventing diffusion of these dyes in the photographic material of the present invention, various means may be employed. For instance, a ballast group may be introduced into the dyes so as to make them non-diffusive.

A hydrophilic polymer charged oppositely to the dissociated anion dye may be incorporated into a layer along with the dye as a mordant, whereby the dye is localized and fixed in the particular layer due to the interaction of the polymer and the dye molecule, as described in U.S. Pat. Nos. 2,548,564, 4,124,386 and 3,625,694.

A water-insoluble solid dye may be used for coloring a particular layer, as so described in JP-A-56-12639, JP-A-55-155350, JP-A-55-155351, JP-A-63-278838, JP-A-63-197943, and European Patent 15,601.

Fine grains of a metal salt to which dyes have been adsorbed may be used for coloring a particular layer, as described in U.S. Pat. Nos. 2,719,088, 2,496,841 and 2,496,842, and JP-A-60-45237.

The photographic material of the present invention may contain an antifoggant or stabilizer selected from, for example, azoles (e.g., benzothiazolium salts, nitroimidazoles, nitrobenzimidazoles, chlorobenzimidazoles, bromobenzimidazoles, nitroindazoles, benzotriazoles, aminotriazoles); mercapto compounds (e.g., mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines, mercaptotriazines); thioketo compounds (e.g., oxazolinethiones); azaindenes (e.g., triazaindenes, tetrazaindenes (especially 4-hydroxy-substituted (1,3,3a,7)tetrazaindenes), pentazaindenes); benzenethiosulfonic acids; benzenesulfinic acids; and benzenesulfonic acid amides.

The photographic material of the present invention may contain color couplers, preferably non-diffusive couplers having a hydrophobic group called a ballast group in the molecule or polymerized couplers. The couplers may be either 4-equivalent or 2-equivalent with respect to silver ions. The photographic material of the present invention may also contain colored couplers having a color-correcting effect, or couplers capable of releasing a development inhibitor during development of the photographic material (so-called DIR couplers). The photographic material may also contain colorless DIR coupling compounds capable of producing a colorless product by a coupling reaction and releasing a development inhibitor.

Preferred examples of such couplers for use in the present invention are described in JP-A-62-215272, from page 91, right top column, line 4 to page 121, left top column, line 6; and JP-A-2-33144, from page 3, right top column, line 14 to page 18, left top column, last line, and from page 30, right top column, line 6 to page 35, right bottom column, line 11.

Specifically, suitable magenta couplers include 5-pyrazolone couplers, pyrazolobenzimidazole couplers, pyrazolotriazole couplers, pyrazolotetrazole couplers, cyanoacetylchroman couplers, and open-chain acylacetonitrile couplers; suitable yellow couplers include acylacetamide couplers (e.g., benzoylacetanilides, pivaloylacetanilides); and suitable cyan couplers include naphthol couplers and phenol couplers. Preferred cyan couplers include phenol couplers having an ethyl group at the meta-position of the phenol nucleus, 2,5-diacylamino-substitued phenol couplers, phenol couplers having a phenylureido group at the 2-position and having an acylamino group at the 5-position, and naphthol couplers having a sulfonamido or amido group at the 5-position of the naphthol nucleus, such as those described in U.S. Pat. Nos. 3,772,002, 2,772,162, 3,758,308, 4,126,396, 4,334,011, 4,327,173, 3,446,622, 4,333,999, 4,451,559 and 4,427,767, as they form fast images.

Two or more different kinds of the above-mentioned couplers may be incorporated into one and the same layer, or one and the same compound of the couplers may be added to two or more layers, for the purpose of satisfying the intended characteristics of the photographic material of the present invention.

The photographic material of the present invention may contain an anti-fading agent selected from, for example, hindered phenols such as hydroquinones, 6-hydroxychromans, 5-hydroxycoumarans, spirochromans, p-alkoxyphenols and hisphenols; and gallic acid derivatives, methylenedioxybenzenes, aminophenols, hindered amines and ether or ester derivatives of them formed by silylating or alkylating the phenolic hydroxyl group of the compounds. In addition, metal complexes such as bis(salicylaldoximato)nickel complexes and bis(N,N-dialkyldithiocarbamato)nickel complexes may also be used as an anti-fading agent.

For photographic processing of the photographic material of the present invention, any known method and any known processing solution may be employed. The processing temperature may be selected generally from the range between 18° C. and 50° C. However, it may be lower than 18° C. or higher than 50° C. In accordance with the object of the photographic material, either black-and-white development for forming a silver image or color development for forming a color image may be employed.

As a black-and-white developer for the former black-and-white development, any known developing agent, such as dihydroxybenzenes (e.g., hydroquinone), 3-pyrazolidones (e.g., 1-phenyl-3-pyrazolidone) and aminophenols (e.g., N-methyl-p-aminophenol) may be employed singly or in combinations of them.

The color developer for the latter color development is generally an alkaline aqueous solution containing a color developing agent. The color developing agent in it may be a known primary aromatic amine developing agent, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline).

In addition, the color developing agents described in F .A. Meson, *Photographic Processing Chemistry.* (published by Focal Press Co., 1966), pp. 226–229 and in U.S. Pat. Nos. 2,193,015 and 2,592,364, and JP-A-48-64933 may also be used.

The developer may additionally contain a pH buffer such as alkali metal sulfites, carbonates, borates or phosphates, as well as a development inhibitor or anti-foggant such as bromides, iodides or organic antifoggants. If desired, it may also contain a water softener; a preservative such as hydroxylamine; an organic solvent such as benzyl alcohol or diethylene glycol; a development accelerator such as polyethylene glycol, quaternary ammonium salts or amines; a dye forming coupler; a competing coupler; a foggant such as sodium boronhydride; a developing aid such as 1-phenyl-3-pyrazolidone; a thickener; a polycarboxylic acid chelating agent such as those described in U.S. Pat. No. 4,083,723; and an antioxidant such as those described in German Patent OLS No. 2,622,950.

After being color-developed, the color photographic material is generally bleached. Bleaching of the material may be carried out simultaneously with or separately from fixation. Suitable bleaching agents to be used for bleaching the material include, for example, compounds of polyvalent metals such as iron(III), cobalt(III), chromium(VI) and copper(II), as well as peracids, quinones and nitroso compounds. Specific examples of suitable bleaching agents include ferricyanides; bichromates; organic complexes of iron(III) or cobalt(III), such as complexes with aminopolycarboxylic acids (e.g., ethylenediaminetetraacetic acid, nitrilotriacetic acid, 1,3-diamino-2-propanol-tetraacetic acid) or with organic acids (e.g., citric acid, tartaric acid, malic acid); persulfates; permanganates; and nitrosophenols. Of them, especially advantageous are potassium ferricyanide, sodium ethylenediaminetetraacetato/iron(III) and ammonium ethylenediaminetetraacetato/iron(III). Ethylenediaminetetraacetato/iron(II) complexes are useful both in an independent bleaching solution and in a one-bath bleach-fixing solution.

The bleaching solution or bleach-fixing solution to be used for processing the photographic material of the present invention may contain various additives, for example, a bleaching accelerator such as those described in U.S. Pat. Nos. 3,042,520 and 3,241,966, JP-B-45-8506, and JP-B-45-8836; and a thiol compound such as those described in JP-A-53-65732. After being bleached or bleach-fixed, the photographic material may be rinsed in water or may be directly stabilized in a stabilizing bath without rinsing in water.

The support of the photographic material of the present invention may be any ordinary transparent film support such as a cellulose nitrate film or polyethylene terephthalate film support, or a reflective support, which is used in forming ordinary photographic materials.

The "reflective support" of the photographic material of the present invention is one which elevates the reflectivity of the support itself to make the color image formed in the silver halide emulsion layer clear and sharp. Reflective supports of this kind include a support coated with a hydrophobic resin containing a dispersion of a photo-reflective substance, such as titanium oxide, zinc oxide, calcium carbonate or calcium sulfate, so as to elevate the reflectivity of the support to light within the visible ray wavelength range, and a support made of a hydrophobic resin containing a dispersion of such a photo-reflective substance. Examples of suitable reflective supports include a baryta paper, a polyethylene-coated paper, a polypropylene synthetic paper, and a transparent support coated with a reflective layer thereon or containing a reflective substance therein. Suitable transparent supports include, for example, a glass sheet, a polyester film such as polyethylene terephthalate, cellulose triacetate or cellulose nitrate film, as well as a polyamide film, a polycarbonate film, a polystyrene film, and a polyvinyl chloride resin film. These supports are suitably selected in accordance with the use and object of the photographic material.

Exposure of the photographic material of the present invention for forming a photographic image thereon may be effected by any ordinary means. For instance, any one of various known light sources, such as natural light (sunlight), a tungsten lamp, a fluorescent lamp, a mercury lamp, a xenon-arc lamp, a carbon-arc lamp, a xenon-flash lamp, lasers, an LED and a CRT can be used for exposure. The exposing time may be any ordinary one for ordinary cameras of from 1/1000 second to one second. As the case may be, shorter exposures of less than 1/1000 second, for example from $1/10^6$ to $1/10^4$ second, may be applied to the photographic material of the present invention by the use of a xenon-flash lamp; or longer exposures of more than one second may be applied thereto. If desired, a color filter may be used for exposure of the photographic material of the present invention for adjusting the spectral composition of the light to be applied thereto. Laser rays may be used for exposure of the material. If desired, the material may also be exposed with a light to be emitted from phosphors as excited with electron rays, X rays, γ rays or α rays.

The present invention will be described in more detail by way of the following examples, but it should be understood that the present invention is not to be deemed to be limited thereto.

EXAMPLE 1

To a reaction vessel were added 1000 ml of water, 25 g of deionized ossein gelatin, 15 ml of a 50% aqueous solution of $NH_4NO_3$ and 7.5 ml of a 25% aqueous solution of $NH_3$. The temperature of the mixture was kept at 50° C. with vigorous stirring. To the mixture were added 750 ml of an aqueous solution of 1N silver nitrate and an aqueous solution of 1N potassium bromide over a period of 50 minutes while the silver potential was kept at +60 mV versus saturated calomel electrode during the reaction. The aqueous solution of 1N potassium bromide was added in an amount necessary for keeping the silver potential at 60 mV.

The resulting silver bromide grains were cubic and had a side length of 0.76±0.06 μm. The temperature of the resulting emulsion was lowered. A copolymer of isobutene and monosodium maleate as a flocculating agent was added thereto, and the emulsion was washed with water and desalted by a precipitation method. Subsequently, 95 g of deionized ossein gelatin and 430 ml of water were added thereto. The pH of the emulsion was adjusted to 6.5, and the pAg was adjusted to 8.3 at 50° C. Sodium thiosulfate was added thereto at 40° C., and the emulsion was ripened at 55° C. for 45 minutes so as to provide the optimum sensitivity. The emulsion contained 0.74 mol of silver bromide per kg.

Sensitizing dyes shown in Tables 2 and 3 below were added to 55 g of the emulsion at 35° C., and the emulsion was ripened at 55° C. for 30 minutes. The temperature of the emulsion was lowered to 40° C., and the metallocene compounds shown in Tables 2 and 3 were added thereto. Further, 10 mg of 4-hydroxy-6-methyl-1,3,3a,7-tetrazaindene, 15 g of a 10% gel of deionized gelatin and 55 ml of water were added thereto. The resulting coating solution was coated on a cellulose triacetate film base in such an amount as to provide the following coating weights.

The amount of the coating solution was set so as to provide 2.5 g/m$^2$ of silver and 3.8 g/m$^2$ of gelatin. An aqueous solution comprising mainly 0.22 g of sodium dodecylbenzenesulfonate per liter, 0.50 g of p-sulfostyrene sodium homopolymer per liter, 3.9 g of 1,3-bis-(vinylsulfonyl)-2-propanol per liter and 50 g of gelatin per liter was simultaneously coated as the upper layer in such an amount as to provide 1.0 g/m$^2$ of gelatin.

Each of the coated samples prepared above was exposed to light through a continuous wedge for one second by using a tungsten lamp (2856° K.), a blue color filter V40 (a band pass filter which transmits light in the range of 370 to 440 nm, a product of Toshiba Glass Co., Ltd.) and an orange color filter SC 54 (which transmits light having a wavelength of 520 nm more, a product of Fuji Photo Film Co., Ltd.). Each of the exposed samples was developed with a developing solution (prepared by three times diluting D-72 developing solution and then adjusting the pH thereof to 10.4), stopped, fixed, rinsed and dried. The density of each sample was measured by using a densitometer (a product of Fuji Photo Film Co., Ltd.) to determine the blue filter sensitivity ($S_B$), the orange filter sensitivity ($S_O$) and fog. The reciprocal of an exposure amount providing an optical density of (fog+0.2) is referred to as the sensitivity. The sensitivity in terms of the relative sensitivity is shown in Tables when each of the blue filter sensitivity and the orange filter sensitivity of each sample containing no metallocene compound in each group of the samples containing the same spectral sensitizing dye is referred to as 100.

TABLE 2

| Sample No. | Sensitizing Dye and Amount Added ($10^{-4}$ mol/molAg) | | Metallocene Compound and Amount Added ($10^{-3}$ mol/molAg) | | Relative Sensitivity $S_B$ | Relative Sensitivity $S_O$ | Fog | Remarks |
|---|---|---|---|---|---|---|---|---|
| 1-1 | XII-1 | 1.5 | — | — | 100 (standard) | 100 (standard) | 0.03 | |
| 1-2 | " | " | I-1 | 3.0 | 100 | 105 | 0.03 | Invention |
| 1-3 | " | " | " | 15.0 | 110 | 112 | 0.03 | Invention |
| 1-4 | " | " | I-26 | 3.0 | 100 | 110 | 0.03 | Invention |
| 1-5 | " | " | " | 15.0 | 105 | 117 | 0.02 | Invention |
| 1-6 | XII-19 | 2.5 | — | — | 100 (standard) | 100 (standard) | 0.04 | |
| 1-7 | " | " | I-27 | 4.5 | 112 | 145 | 0.04 | Invention |
| 1-8 | " | " | " | 15.0 | 120 | 155 | 0.03 | Invention |
| 1-9 | " | " | I-31 | 2.0 | 115 | 151 | 0.04 | Invention |
| 1-10 | " | " | " | 10.0 | 117 | 166 | 0.04 | Invention |
| 1-11 | XIV-5 | 3.0 | — | — | 100 (standard) | 100 (standard) | 0.03 | |
| 1-12 | " | " | I-1 | 3.0 | 105 | 123 | 0.04 | Invention |
| 1-13 | " | " | " | 15.0 | 112 | 174 | 0.03 | Invention |
| 1-14 | " | " | I-23 | 3.0 | 123 | 132 | 0.04 | Invention |
| 1-15 | " | " | " | 15.0 | 120 | 234 | 0.03 | Invention |
| 1-16 | XIVI-7 | 3.0 | — | — | 100 (standard) | 100 (standard) | 0.03 | |
| 1-17 | " | " | I-1 | 3.0 | 105 | 126 | 0.03 | Invention |
| 1-18 | " | " | " | 15.0 | 120 | 195 | 0.03 | Invention |
| 1-19 | " | " | I-2 | 0.3 | 123 | 155 | 0.03 | Invention |
| I-20 | " | " | " | 3.0 | 135 | 295 | 0.03 | Invention |
| 1-21 | " | " | " | 15.0 | 87 | 186 | 0.03 | Invention |
| 1-22 | " | " | I-5 | 3.0 | 126 | 195 | 0.03 | Invention |
| 1-23 | " | " | " | 15.0 | 120 | 251 | 0.02 | Invention |
| 1-24 | " | " | I-12 | 0.03 | 120 | 195 | 0.03 | Invention |
| 1-25 | " | " | " | 0.3 | 123 | 282 | 0.03 | Invention |
| 1-26 | " | " | " | 3.0 | 71 | 117 | 0.03 | Invention |
| 1-27 | " | " | I-14 | 0.03 | 93 | 126 | 0.03 | Invention |
| 1-28 | " | " | " | 0.3 | 129 | 209 | 0.03 | Invention |

TABLE 2-continued

| Sample No. | Sensitizing Dye and Amount Added ($10^{-4}$ mol/molAg) | | Metallocene Compound and Amount Added ($10^{-3}$ mol/molAg) | | Relative Sensitivity $S_B$ | $S_O$ | Fog | Remarks |
|---|---|---|---|---|---|---|---|---|
| 1-29 | " | " | " | 3.0 | 110 | 166 | 0.03 | Invention |

TABLE 3

| Sample No. | Sensitizing Dye and Amount Added ($10^{-4}$ mol/molAg) | | Metallocene Compound and Amount Added ($10^{-3}$ mol/molAg) | | Relative Sensitivity $S_B$ | $S_O$ | Fog | Remarks |
|---|---|---|---|---|---|---|---|---|
| 1-16 | XIV-7 | 3.0 | — | — | 100 (standard) | 100 (standard) | 0.03 | |
| 1-30 | " | " | I-15 | 0.03 | 145 | 195 | 0.03 | Invention |
| 1-31 | " | " | " | 0.3 | 110 | 331 | 0.03 | Invention |
| 1-32 | " | " | " | 15.0 | 110 | 112 | 0.03 | Invention |
| 1-33 | " | " | I-31 | 0.3 | 107 | 129 | 0.03 | Invention |
| 1-34 | " | " | " | 3.0 | 117 | 162 | 0.02 | Invention |
| 1-35 | " | " | " | 15.0 | 138 | 240 | 0.03 | Invention |
| 1-36 | XIV-7 | 4.5 | — | — | 100 (standard) | 100 (standard) | 0.03 | |
| 1-37 | " | " | I-1 | 4.5 | 105 | 224 | 0.03 | Invention |
| 1-38 | " | " | " | 22.5 | 102 | 331 | 0.03 | Invention |
| 1-39 | " | " | I-27 | 4.5 | 107 | 245 | 0.03 | Invention |
| 1-40 | " | " | " | 22.5 | 105 | 371 | 0.03 | Invention |
| 1-41 | XII-8 | 3.0 | — | — | 100 (standard) | 100 (standard) | 0.04 | |
| 1-42 | " | " | I-1 | 0.3 | 100 | 117 | 0.03 | Invention |
| 1-43 | " | " | " | 3.0 | 95 | 117 | 0.04 | Invention |
| 1-44 | " | " | I-7 | 0.3 | 100 | 178 | 0.04 | Invention |
| 1-45 | " | " | " | 3.0 | 95 | 174 | 0.04 | Invention |
| 1-46 | " | " | I-24 | 0.6 | 100 | 162 | 0.03 | Invention |

It is apparent from the results shown in Tables 2 and 3 that when the sensitizing dyes are used together with the metallocene compounds, the spectral sensitivity ($S_O$) can be increased.

EXAMPLE 2

The silver halide emulsion used in Example 2 was prepared in the following manner.

| | |
|---|---|
| Solution (1) | |
| Water | 1000 ml |
| NaCl | 4.65 g |
| Gelatin | 22 g |
| Citric Acid | 0.80 g |
| Solution (2) | |
| KBr | 25.3 g |
| NaCl | 32.3 g |
| $K_2IrCl_6$ (0.005%) | 11.2 ml |
| $Na_3RhCl_6.2H_2O$ ($10^{-5}$ mol/liter) | 18.9 ml |
| Add Water to make | 348 ml |
| Solution (3) | |
| $AgNO_3$ | 120.6 g |
| Add Water to make | 348 ml |
| Solution (4) | |
| KBr | 30.0 g |
| NaCl | 48.7 g |
| Add Water to make | 552 ml |
| Solution (5) | |
| $AgNO_3$ | 176.3 g |

-continued

| | |
|---|---|
| Add Water to make | 552 ml |

Solution (1) was heated to 50° C., and 262 ml of Solution (2) and 262 ml of Solution (3) were simultaneously added thereto at a given flow rate over a period of 12 minutes. Subsequently, Solution (4) and Solution (5) were simultaneously added thereto over a period of 20 minutes. The temperature of the mixture was lowered, and a copolymer of isobutene and monosodium maleate as a flocculating agent was added thereto, and the resulting emulsion was washed with water and desalted by a precipitation method. Water and ossein gelatin were then added thereto. The pH of the emulsion was adjusted to 6.1, and the pAg thereof was adjusted to 7.5. The thus prepared silver chlorobromide emulsion comprised monodisperse cubic grains having an average side length of 0.28 μm, a coefficient of variation (a value s/d obtained by dividing standard deviation by average side length) of 0.08 and a silver bromide content of 30 mol %.

Sodium thiosulfate, chloroauric acid and potassium thiocyanate were added to the emulsion. The emulsion was ripened at 55° C. to carry out chemical sensitization so as to obtain the optimum sensitivity. The emulsion was divided into portions. The sensitizing dyes shown in Table 4 below were added to these portions at 50° C. as shown in Table 4 below. After 20 minutes, the metallocene compounds according to the present invention and $7.5\times10^{-4}$ mol of 4-hydroxy-5,6-propanol-1,3,3a,7-tetrazaindene per mol of silver chlorobromide were added as shown in Table 4 below.

To each of these emulsions were added 280 g of a 10% gel of deionized gelatin and 1.04 liters of water, each amount being kg of the emulsion. Subsequently, 7 g of 1,2-bis(vinylsulfonylacetylamino)ethane per kg of the emulsion was added. The resulting emulsion was coated on a polyethylene terephthalate film base in such an amount as to provide a coating weight of 1.2 g/m$^2$ in terms of silver in the same manner as in Example 1.

These samples were exposed to light an developed in the same manner as in Example 1 except that development was carried out at 38° C. for 20 seconds by using a developing solution LD-835 (a product of Fuji Photo Film Co., Ltd.). The density of each sample was measured in the same manner as in Example 1. The sensitivity and fog were determined. The results obtained are shown in Table 4 below. The reciprocal of an exposure amount providing an optical density of (fog+0.5) is referred to as the sensitivity. The sensitivity in terms of the relative sensitivity is shown in Table 4 below when each of the blue filter sensitivity ($S_B$) and the orange filter sensitivity ($S_O$) of each sample containing no metallocene compound in each group of the samples containing the same spectral sensitizing dyes is referred to as 100.

Further, a change in the sensitivity was examined after the samples were stored at 25° C. under oxygen partial pressure of 10 arms for 4 days. The change in the sensitivity is referred to as raw preservability with time, and the results obtained are shown in Table 4 below. Namely, after the samples are stored at 25° C. under oxygen partial pressure of 10 arms for 4 days, the samples are exposed to light and developed as described above. The orange filter sensitivity of each of the exposed and developed samples in terms of the relative sensitivity is shown in Table 4 below when the orange filter sensitivity of the corresponding sample which is not stored is referred to as 100.

low in fog and provide high sensitivity and at the same time, the problem of a lowering in the sensitivity caused by oxygen can be effectively improved.

EXAMPLE 3

To one liter of a 2% aqueous solution of gelatin were added 6.5 g of potassium bromide, 1.2 g of potassium iodide and 4.9 g of potassium thiocyanate. While the mixture was stirred at 70° C., 0.4 liters of an aqueous solution containing 57.5 g of potassium bromide and 2.5 g of potassium iodide and 0.4 liters of an aqueous solution containing 85 g of silver nitrate were added thereto at an equal flow rate over a period of 45 minutes by the double jet process. A copolymer of isobutene and monosodium maleate was then added thereto at 35° C. The pH of the resulting emulsion was adjusted to 3.8. The emulsion was washed with water and desalted by a precipitation method. Subsequently, gelatin, water and phenol were added thereto. The pH of the emulsion was adjusted to 6.8, and the pAg thereof was adjusted to 8.7. The thus obtained silver halide grains had an average diameter of 1.74 μm and an average thickness of 0.23 μm (an average ratio of the diameter/the thickness was 7.57). The emulsion was divided into portions. The sensitizing dye shown in Table 5 below was added to each portion at 35° C. After the emulsion was ripened with stirring for 15 minutes, sodium thiosulfate pentahydrate, potassium tetraaurate and potassium thiocyanate were added thereto. The temperature was rapidly raised to 60° C., and the emulsion was ripened so as to obtain the optimum sensitivity.

The metallocene compounds shown in Table 5 below were added to the thus prepared silver iodobromide emulsions at 40° C. Further, a 14% gel of deionized gelatin and $2\times10^{-3}$ mol of 4-hydroxy-6-methyl-1,3,3a,7-tetrazaindene

TABLE 4

| Sample | Sensitizing Dye and Amount Added | | Metallocene Compound and Amount Added | | Relative Sensitivity | | | Raw Preservability with Time | |
|---|---|---|---|---|---|---|---|---|---|
| No. | ($10^{-4}$ mol/molAg) | | ($10^{-3}$ mol/molAg) | | $S_B$ | $S_O$ | Fog | $\Delta S_O$ | Remarks |
| 2-1 | XI-5 | 8.0 | — | — | 100 (standard) | 100 (standard) | 0.02 | 85 | |
| 2-2 | " | " | I-1 | 2.6 | 120 | 123 | 0.02 | 93 | Invention |
| 2-3 | " | " | " | 13.0 | 129 | 141 | 0.02 | 95 | Invention |
| 2-4 | XI-14 | 2.5 | — | — | 100 (standard) | 100 (standard) | 0.02 | 91 | |
| 2-5 | " | " | I-23 | 5.2 | 169 | 214 | 0.02 | 95 | Invention |
| 2-6 | " | " | " | 20.8 | 191 | 309 | 0.02 | 100 | Invention |
| 2-7 | XI-16 | 2.5 | — | — | 100 (standard) | 100 (standard) | 0.02 | 91 | |
| 2-8 | " | " | I-26 | 2.6 | 148 | 269 | 0.02 | 98 | Invention |
| 2-9 | " | " | " | 13.0 | 162 | 302 | 0.02 | 100 | Invention |
| 2-10 | XI-40 | 5.0 | — | — | 100 (standard) | 100 (standard) | 0.02 | 69 | |
| 2-11 | " | " | I-1 | 2.6 | 114 | 123 | 0.02 | 87 | Invention |
| 2-12 | " | " | " | 13.0 | 117 | 126 | 0.02 | 91 | Invention |
| 2-13 | " | " | I-31 | 2.6 | 135 | 138 | 0.02 | 89 | Invention |
| 2-14 | " | " | " | 13.0 | 132 | 148 | 0.02 | 95 | Invention |
| 2-15 | XI-44 | 6.8 | — | — | 100 (standard) | 100 (standard) | 0.02 | 74 | |
| 2-16 | " | " | I-1 | 2.6 | 125 | 125 | 0.02 | 89 | Invention |
| 2-17 | " | " | " | 13.0 | 125 | 120 | 0.02 | 93 | Invention |
| 2-16 | " | " | I-7 | 2.6 | 132 | 129 | 0.02 | 87 | Invention |
| 2-17 | " | " | " | 13.0 | 123 | 132 | 0.02 | 87 | Invention |
| 2-18 | " | " | I-31 | 2.6 | 135 | 145 | 0.02 | 89 | Invention |
| 2-19 | " | " | " | 13.0 | 135 | 155 | 0.02 | 95 | Invention |
| 2-20 | XIII-1 | 1.0 | — | — | 100 (standard) | 100 (standard) | 0.02 | 89 | |
| 2-21 | " | " | II-31 | 0.1 | 115 | 120 | 0.02 | 89 | Invention |
| 2-22 | " | " | " | 1.0 | 135 | 162 | 0.02 | 93 | Invention |
| 2-23 | " | " | " | 10.0 | 129 | 209 | 0.02 | 95 | Invention |

It will be understood from the results shown in Table 4 that the combinations according to the present invention are per mol of silver iodobromide were added thereto. After the mixture was mixed with stirring, each of the emulsions was coated on an antistatic-processed polyethylene terephthalate film base in the same manner as in Example 1.

The coated samples were exposed to light and developed, and density was measured in the same manner as in Example 1. The results of the sensitivity and fog obtained are shown in Table 5 below. The reciprocal of an exposure amount providing an optical density of (fog+0.2) is referred to as the sensitivity. The sensitivity in terms of the relative sensitivity is shown in Table 5 below when each of the blue filter sensitivity ($S_B$) and the orange filter sensitivity ($S_O$) of each sample containing no metallocene compound in each group of the samples containing the same spectral sensitizing dyes is referred to as 100.

Further, the latent image stability was examined when exposure to light was conducted through the orange filter. The results obtained are shown in Table 5 below.

Namely, after the exposed samples were stored at 50° C. and 30% RH for 5 days, the samples were developed. The orange filter sensitivity of each of the developed samples in terms of the relative sensitivity ($\Delta R_O$) is shown in Table 5 below when the orange filter sensitivity of the corresponding sample which is not stored is referred to as 100.

TABLE 5

| Sample No. | Sensitizing Dye and Amount Added ($10^{-4}$ mol/molAg) | | Metallocene Compound and Amount Added ($10^{-3}$ mol/molAg) | | Relative Sensitivity $S_B$ | Relative Sensitivity $S_O$ | Fog | Latent Image Stability $\Delta S_O$ | Remarks |
|---|---|---|---|---|---|---|---|---|---|
| 3-1 | XI-35 | 7.1 | — | — | 100 (standard) | 100 (standard) | 0.03 | 87 | |
| 3-2 | " | " | I-1 | 0.3 | 100 | 123 | 0.03 | 93 | Invention |
| 3-3 | " | " | " | 3.0 | 100 | 117 | 0.03 | 98 | Invention |
| 3-4 | " | " | I-13 | 0.3 | 100 | 145 | 0.03 | 91 | Invention |
| 3-5 | " | " | " | 3.0 | 100 | 162 | 0.03 | 98 | Invention |
| 3-6 | " | " | " | 15.0 | 95 | 148 | 0.03 | 102 | Invention |
| 3-7 | XIV-3 | 4.7 | — | — | 100 (standard) | 100 (standard) | 0.03 | 91 | |
| 3-8 | " | " | I-26 | 2.6 | 148 | 269 | 0.03 | 98 | Invention |
| 3-9 | " | " | " | 13.0 | 162 | 302 | 0.03 | 100 | Invention |
| 3-10 | XIV-7 | 4.7 | — | — | 100 (standard) | 100 (standard) | 0.03 | 89 | |
| 3-11 | " | " | I-1 | 3.0 | 100 | 115 | 0.03 | 95 | Invention |
| 3-12 | " | " | " | 15.0 | 105 | 134 | 0.03 | 98 | Invention |
| 3-13 | " | " | I-23 | 0.6 | 100 | 138 | 0.03 | 91 | Invention |
| 3-14 | " | " | " | 3.0 | 115 | 155 | 0.03 | 95 | Invention |
| 3-15 | " | " | " | 15.0 | 120 | 170 | 0.03 | 95 | Invention |
| 3-16 | " | " | I-32 | 0.6 | 100 | 120 | 0.03 | 93 | Invention |
| 3-17 | " | " | " | 3.0 | 110 | 138 | 0.03 | 100 | Invention |
| 3-18 | " | " | " | 10.0 | 95 | 132 | 0.04 | 100 | Invention |

It will be understood from the results shown in Table 5 that when the silver iodobromide emulsion is used, the combinations of the present invention have such an effect that fog is also low, and the sensitivity can be greatly increased as in the use of other silver halide emulsions, and further the stability of the latent image can be increased.

EXAMPLE 4

The following layers having the following compositions were coated on an undercoated cellulose triacetate film base to prepare a multi-layer color photographic material as Sample 4-1. All sensitizing dyes used were added before the commencement of the chemical ripening of the silver halide emulsions, namely, before the addition of the chemical sensitizing agents.

Layer Structure

Each layer had the following composition. Numerals represent coating weights (g/m$^2$). The amounts of the silver halide emulsions are represented by coating weights in terms of silver.

Sample 4-1

| | |
|---|---|
| First Layer (antihalation layer) | |
| Black Colloidal Silver (in terms of silver) | 0.18 |
| Gelatin | 1.40 |
| Second Layer (interlayer) | |
| 2,5-Di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Third Layer (first red-sensitive emulsion layer) | |
| Emulsion A (in terms of silver) | 0.25 |
| Emulsion B (in terms of silver) | 0.25 |
| Sensitizing Dye (XI-1) | $6.9 \times 10^{-5}$ |

-continued

| | |
|---|---|
| Sensitizing Dye (XIV-15) | $1.8 \times 10^{-5}$ |
| Sensitizing Dye (XIV-7) | $3.1 \times 10^{-5}$ |
| EX-2 | 0.34 |
| EX-10 | 0.02 |
| U-1 | 0.07 |
| U-2 | 0.05 |
| U-3 | 0.07 |
| HBS-1 | 0.06 |
| Gelatin | 0.87 |
| Fourth Layer (second red-sensitive emulsion layer) | |
| Emulsion G (in terms of silver) | 1.00 |
| Sensitizing Dye (XI-1) | $5.1 \times 10^{-5}$ |
| Sensitizing Dye (XIV-15) | $1.4 \times 10^{-5}$ |
| Sensitizing Dye (XIV-7) | $2.3 \times 10^{-5}$ |
| EX-2 | 0.40 |
| EX-3 | 0.05 |
| EX-10 | 0.015 |
| U-1 | 0.07 |
| U-2 | 0.05 |
| U-3 | 0.07 |

-continued

| | |
|---|---|
| Gelatin | 1.30 |
| Fifth Layer (third red-sensitive emulsion layer) | |
| Emulsion D (in terms of silver) | 1.60 |
| Sensitizing Dye (XI-1) | $5.4 \times 10^{-5}$ |
| Sensitizing Dye (XIV-15) | $1.4 \times 10^{-5}$ |
| Sensitizing Dye (XIV-7) | $2.4 \times 10^{-5}$ |
| EX-2 | 0.097 |
| EX-3 | 0.01 |
| EX-4 | 0.08 |
| HBS-1 | 0.22 |
| HBS-2 | 0.10 |
| Gelatin | 1.63 |
| Sixth Layer (interlayer) | |
| EX-5 | 0.04 |
| HBS-1 | 0.02 |
| Gelatin | 0.80 |
| Seventh Layer (first green-sensitive emulsion layer) | |
| Emulsion A (in terms of silver) | 0.15 |
| Emulsion B (in terms of silver) | 0.15 |
| Sensitizing Dye (XI-45) | $3.0 \times 10^{-5}$ |
| Sensitizing Dye (XI-48) | $1.0 \times 10^{-4}$ |
| Sensitizing Dye (XI-38) | $3.8 \times 10^{-4}$ |
| EX-1 | 0.021 |
| EX-6 | 0.26 |
| EX-7 | 0.03 |
| EX-8 | 0.025 |
| HBS-1 | 0.10 |
| HBS-3 | 0.01 |
| Gelatin | 0.63 |
| Eighth Layer (second green-sensitive emulsion layer) | |
| Emulsion C (in terms of silver) | 0.45 |
| Sensitizing Dye (XI-45) | $2.1 \times 10^{-5}$ |
| Sensitizing Dye (XI-48) | $7.0 \times 10^{-5}$ |
| Sensitizing Dye (XI-38) | $2.6 \times 10^{-4}$ |
| EX-6 | 0.094 |
| EX-7 | 0.026 |
| EX-8 | 0.018 |
| HBS-1 | 0.16 |
| HBS-3 | 0.008 |
| Gelatin | 0.50 |
| Ninth Layer (third green-sensitive emulsion layer) | |
| Emulsion E (in terms of silver) | 1.20 |
| Sensitizing Dye (XI-45) | $3.5 \times 10^{-5}$ |
| Sensitizing Dye (XI-48) | $8.0 \times 10^{-5}$ |
| Sensitizing Dye (XI-38) | $3.0 \times 10^{-4}$ |
| EX-1 | 0.025 |
| EX-11 | 0.10 |
| EX-13 | 0.015 |
| HBS-1 | 0.25 |
| HBS-2 | 0.10 |
| Gelatin | 1.54 |
| Tenth Layer (yellow filter layer) | |
| Yellow Colloidal Silver (in terms of silver) | 0.05 |
| EX-5 | 0.08 |
| HBS-1 | 0.03 |

-continued

| | |
|---|---|
| Gelatin | 0.95 |
| Eleventh Layer (first blue-sensitive emulsion layer) | |
| Emulsion A (in terms of silver) | 0.08 |
| Emulsion B (in terms of silver) | 0.07 |
| Emulsion F (in terms of silver) | 0.07 |
| Sensitizing Dye (XI-28) | $3.5 \times 10^{-4}$ |
| EX-8 | 0.042 |
| EX-9 | 0.72 |
| HBS-1 | 0.28 |
| Gelatin | 1.10 |
| Twelfth Layer (second blue-sensitive emulsion layer) | |
| Emulsion G (in terms of silver) | 0.45 |
| Sensitizing Dye (XI-28) | $2.1 \times 10^{-4}$ |
| EX-9 | 0.15 |
| EX-10 | 0.007 |
| HBS-1 | 0.05 |
| Gelatin | 0.78 |
| Thirteenth Layer (third blue-sensitive emulsion layer) | |
| Emulsion H (in terms of silver) | 0.77 |
| Sensitizing Dye (XI-28) | $2.2 \times 10^{-4}$ |
| EX-9 | 0.20 |
| HBS-1 | 0.07 |
| Gelatin | 0.69 |
| Fourteenth Layer (first protective layer) | |
| Emulsion I (in terms of silver) | 0.20 |
| U-4 | 0.11 |
| U-5 | 0.17 |
| HBS-1 | 0.05 |
| Gelatin | 1.00 |
| Fifteenth Layer (second protective layer) | |
| HA-1 | 0.40 |
| BP-1 (diameter: 1.7 μm) | 0.05 |
| BP-2 (diameter: 1.7 μm) | 0.10 |
| BP-3 | 0.10 |
| S-1 | 0.20 |
| Gelatin | 1.20 |

Further, all layer contained W-1, W-2, W-3, BP-4, BP-5, 5-methylthio-2-mercapto-1,3,4-thiadiazole, 1-p-carboxyphenyl-5-mercaptotetrazole, 1-m-sulfophenyl-5mercaptotetrazole, 5-nitro-1H-indazole, 5-methyl-1H-benzotriazole, 2-mercaptobenzothiazole, 6-(2-ethylhexanoylamino)-2-mercaptobenzimidazole, 1-m-(3-methylureido) phenyl-5-mercaptotetrazole, α-lipoic acid, 2-hydroxyamino-4,6-bis(hexylamino)-1,3,5-triazole, 2-hydroxyamino-4,6-bis(ethylamino)-1,3,5-triazole, 4-hydroxy-6-methyl-1,3,3a,7-tetrazaindene, sodium p-toluenesulfinate, an iron salt, a lead salt, a gold salt, a platinum salt, an iridium salt and a rhodium salt to improve preservability, processability, pressure resistance, antifungal and anti-microbial properties, antistatic properties and coatability.

TABLE 6

| Emulsion | Average AgI Content (%) | Mean Grain Size (μm) | Coefficient of Variation in Grain Size Distribution (%) | Ratio of Diameter/ Thickness | Ratio of Amount of Silver (AgI content %) |
|---|---|---|---|---|---|
| A | 4.0 | 0.45 | 27 | 1 | core/shell = 1/3(13/1), double structural grains |
| B | 8.9 | 0.70 | 14 | 1 | core/shell = 3/7(25/2), double structural grains |
| C | 10 | 0.75 | 30 | 2 | core/shell = 1/2(24/3), double structural grains |
| D | 16 | 1.05 | 35 | 2 | core/shell = 4/6(40/0), double structural grains |
| E | 10 | 1.05 | 35 | 3 | core/shell = 1/2(24/3), double structural grains |
| F | 4.0 | 0.25 | 28 | 1 | core/shell = 1/3(13/1), double structural grains |

TABLE 6-continued
| Emulsion | Average AgI Content (%) | Mean Grain Size (μm) | Coefficient of Variation in Grain Size Distribution (%) | Ratio of Diameter/ Thickness | Ratio of Amount of Silver (AgI content %) |
|---|---|---|---|---|---|
| G | 14.0 | 0.75 | 25 | 2 | core/shell = 1/2(42/0), double structural grains |
| H | 14.5 | 1.30 | 25 | 3 | core/shell = 37/63(34/3), double structural grains |
| I | 1 | 0.07 | 15 | 1 | uniform structural grains |
EX-1
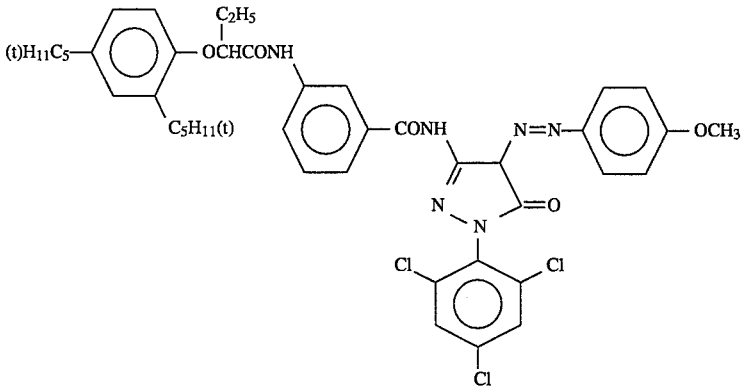
EX-2
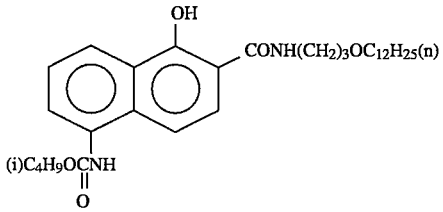
EX-3
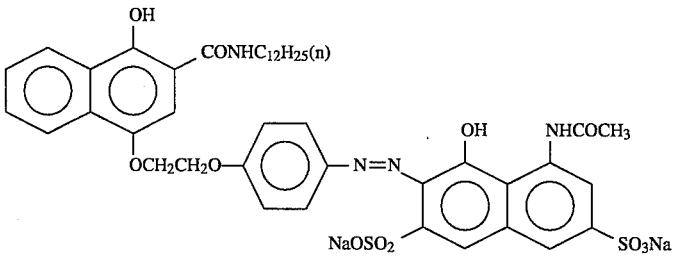
EX-4
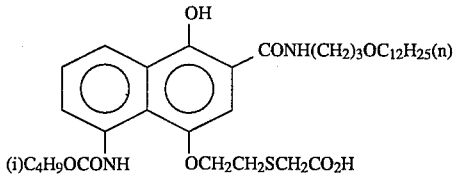
EX-5
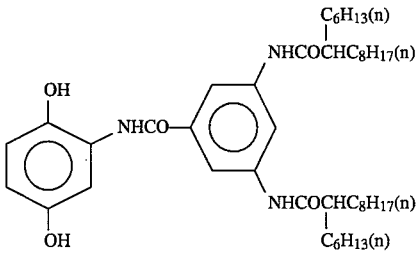

-continued
EX-6
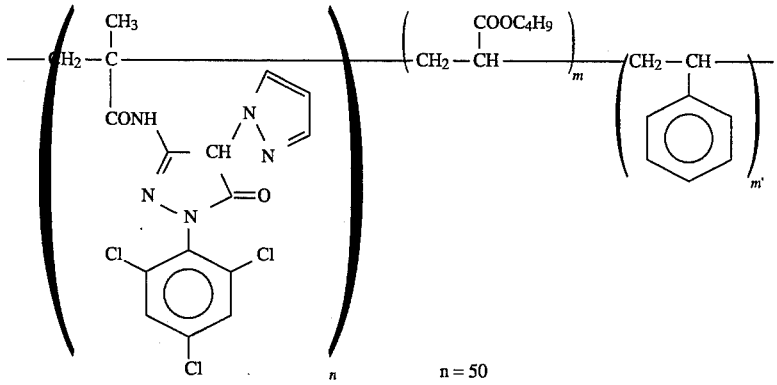
n = 50
m = 25
m' = 25
mol. wt. about 20,000
EX-7
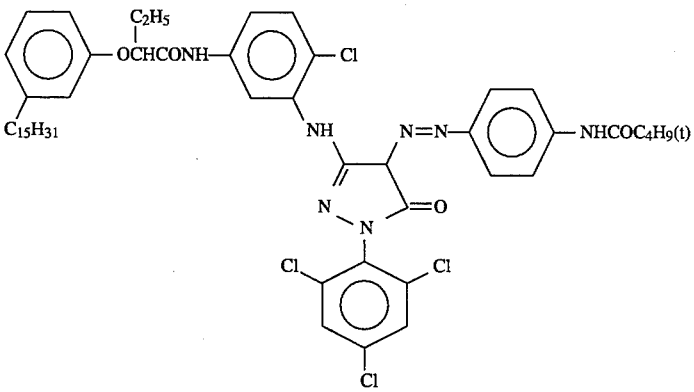
EX-8
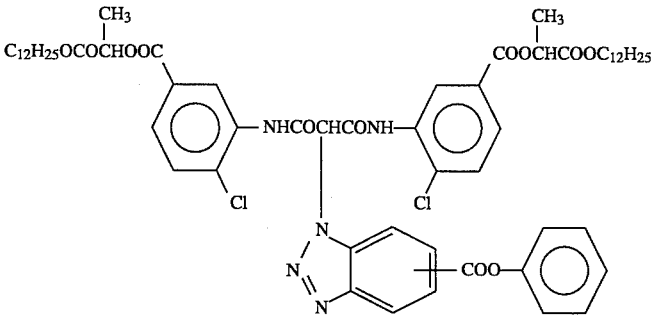
EX-9
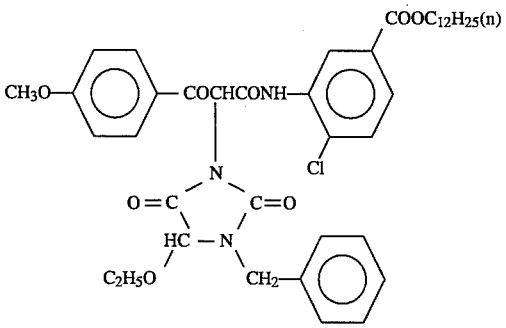

-continued
EX-10
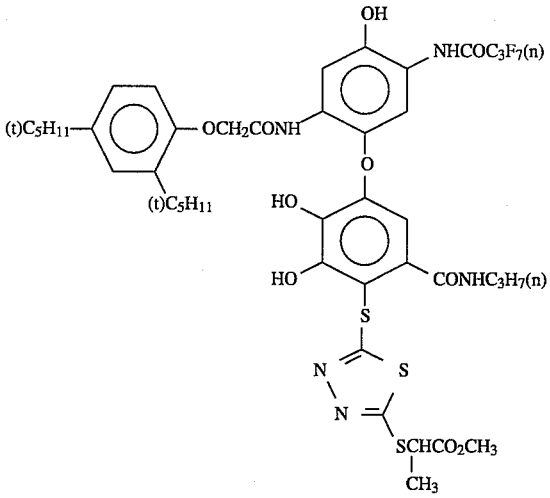
EX-11
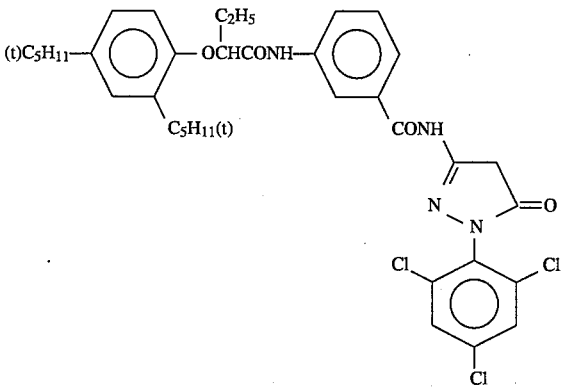
EX-12
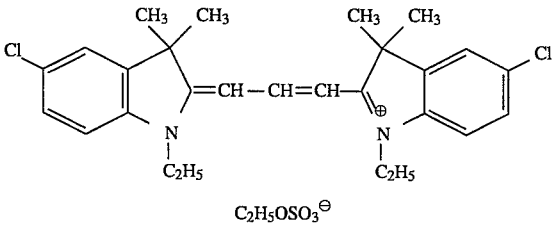
EX-13
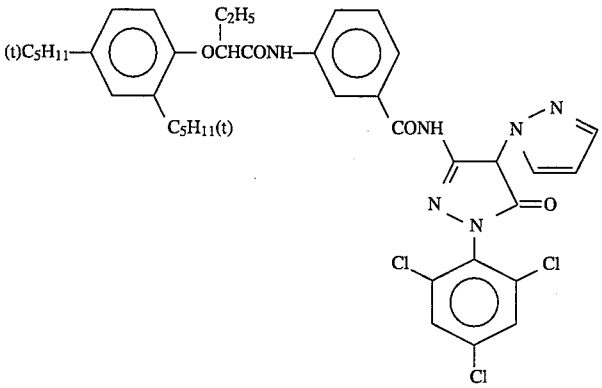

-continued
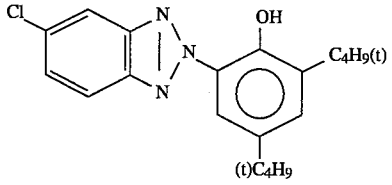
U-1
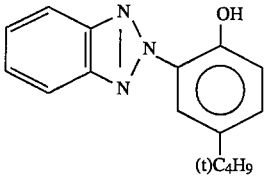
U-2
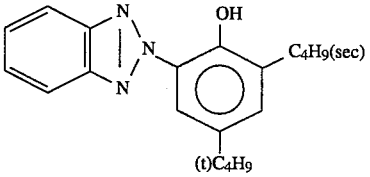
U-3
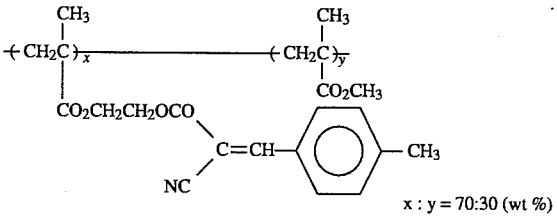
x : y = 70:30 (wt %)
U-4
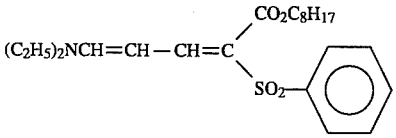
U-5
Tricresyl Phosphate HBS-1
Di-n-butyl Phthalate HBS-2
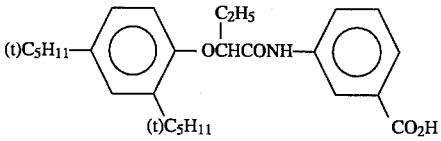
HBS-3
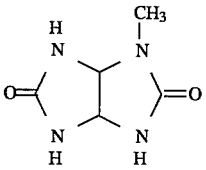
S-1
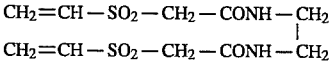
HA-1
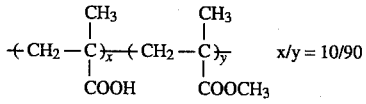
x/y = 10/90
BP-1
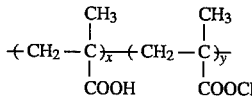
x/y = 40/60
BP-2

-continued

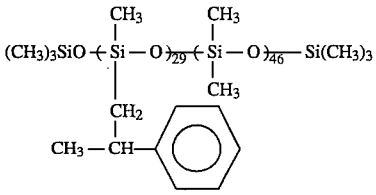

BP-3

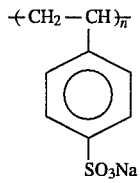

BP-4

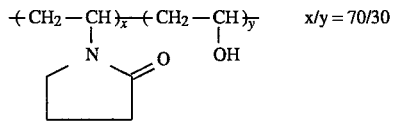

x/y = 70/30

BP-5

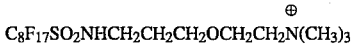

W-1

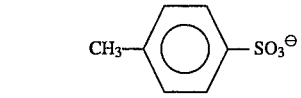

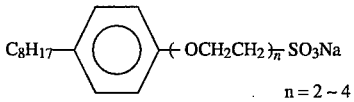

n = 2 ~ 4

W-2

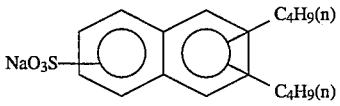

W-3

Sample 4-2 was prepared in the same manner as the preparation of Sample 4-1 except that $8.0\times10^{-3}$ mol of Metallocene Compound (I-1) according to the present invention was added to the first red-sensitive emulsion layer, $6.0\times10^{-3}$ mol of Metallocene Compound (I-1) was added to the second red-sensitive emulsion layer, and $7.5\times10^{-3}$ mol of Metallocene Compound (I-1) was added to the third red-sensitive emulsion layer before the coating of the emulsion, each amount being per mol of silver halide. Further, Sample 4-3 was prepared in the same manner as in the preparation of Sample 4-2 except that an equal amount of Metallocene Compound (I-23) was used in place of Metallocene Compound (I-1). Sample 4-4 was prepared in the same manner as in the preparation of Sample 4-2 except that an equal amount of Metallocene Compound (I-26) was used in place of Metallocene Compound (I-1). Sample 4-5 was prepared in the same manner as in the preparation of Sample 4-2 except that Metallocene Compound (I-32) was used in place of Metallocene Compound (I-1).

These samples were exposed to light through a continuous wedge and a red color filter (which transmits light having a longer wavelength than 600 nm) for 1/100 sec, and processed with the following processing solutions in the following stages. The density of each sample was measured. The reciprocal of an exposure amount providing an optical density of (fog+0.2) is referred to as the sensitivity. The sensitivity in terms of the relative sensitivity is shown in Table 7 below when the sensitivity of Sample 4-1 is referred to as 100. The description of an increase or decrease in fog in Table 7 is shown by an increase or decrease in fog density in comparison with the fog density of Sample 4-1.

Development Method

| Stage | Processing Time | Processing Temperature | Replenisher | Tank Capacity |
|---|---|---|---|---|
| Color Development | 2 min 45 sec | 38° C. | 33 ml | 20 liters |
| Bleaching | 6 min 30 sec | 38° C. | 25 ml | 40 liters |
| Rinsing | 2 min 10 sec | 24° C. | 1200 ml | 20 liters |
| Fixing | 4 min 20 sec | 38° C. | 25 ml | 30 liters |
| Rinsing (1) | 1 min 05 sec | 24° C. | counter-current system of from (2) to (1) | 10 liters |
| Rinsing (2) | 1 min 00 sec | 24° C. | 1200 ml | 10 liters |
| Stabilization | 1 min 05 sec | 38° C. | 25 ml | 10 liters |
| Drying | 4 min 20 sec | 55° C. | | |

Replenisher being per 1 m long by 35 mm wide

The processing solutions had the following compositions.

| | Mother Solution (g) | Replenisher (g) |
|---|---|---|
| Color developing Solution | | |
| Diethylenetriamine-pentaacetic Acid | 1.0 | 1.1 |
| 1-Hydroxyethylidene-1,1-diphosphonic Acid | 3.0 | 3.2 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-[N-Ethyl-N-β-hydroxy-ethylamino]-2-methylaniline Sulfate | 4.5 | 5.5 |
| Add Water to make | 1.0 liter | 1.0 liter |
| pH | 10.05 | 10.10 |
| Bleaching Solution | | |
| Sodium Ethylenediamine-tetraacetato Ferrate Trihydrate | 100.0 | 120.0 |
| Disodium Ethylenediamine-tetraacetate | 10.0 | 11.0 |
| Ammonium Bromide | 140.0 | 160.0 |
| Ammonium Nitrate | 30.0 | 35.0 |
| Ammonia Water (27%) | 6.5 ml | 4.0 ml |
| Add Water to make | 1.0 liter | 1.0 liter |
| pH | 6.0 | 5.7 |
| Fixing Solution | | |
| Disodium Ethylenediamine-tetraacetate | 0.5 | 0.7 |
| Sodium Sulfite | 7.0 | 8.0 |
| Sodium Bisulfite | 5.0 | 5.5 |
| Aqueous Solution of Ammonium Thiosulfate (70%) | 170.0 ml | 200.0 ml |
| Add Water to make | 1.0 liter | 1.0 liter |
| pH | 6.7 | 6.6 |
| Stabilizing Solution | | |
| Formalin (37%) | 2.0 ml | 3.0 ml |
| Polyoxyethylene p-Monononyl-phenyl Ether (an average degree of polymerization: 10) | 0.3 | 0.45 |
| Disodium Ethylenediamine-tetraacetate | 0.05 | 0.08 |
| Add Water to make | 1.0 liter | 1.0 liter |
| pH | 5.0 to 8.0 | 5.8 to 8.0 |

TABLE 7

| Sample No. | Metallocene Compound | Relative Red Sensitivity $S_R$ | Increase or Decrease in Fog | Remarks |
|---|---|---|---|---|
| 4-1 | — | 100 (standard) | (standard) | |
| 4-2 | I-1 | 112 | −0.01 | Invention |
| 4-3 | I-23 | 123 | 0.02 | Invention |
| 4-4 | I-26 | 129 | 0.02 | Invention |
| 4-5 | I-32 | 123 | 0.01 | Invention |

It is apparent from the results shown in Table 7 that when the combinations according to the present invention are applied to the multi-layer color photographic material, fog is not so much increased and high sensitivity can be obtained.

EXAMPLE 5

After the coated Samples 4-1, 4-2, 4-3 and 4-4 prepared in Example 4 were left to stand at room temperature for one year, the samples were exposed to light and developed in the same manner as in Example 4. The red filter sensitivity and fog were determined. The results obtained are shown in Table 8 below.

The sensitivity in terms of the relative sensitivity is shown in Table 8 when the sensitivity of the corresponding sample stored in a refrigerator at −30° C. in an argon atmosphere during the corresponding period is referred to as 100. An increase or decrease in fog is also shown in comparison with the corresponding sample stored in a refrigerator at −30° C. in an argon atmosphere.

TABLE 8

| Sample No. | Metallocene Compound | Relative Red Sensitivity $S_R$ | Increase or Decrease in Fog | Remarks |
|---|---|---|---|---|
| 4-1 | — | 87 | −0.01 | |
| 4-2 | I-1 | 93 | −0.01 | Invention |
| 4-3 | I-23 | 98 | 0.02 | Invention |
| 4-4 | I-26 | 100 | 0.02 | Invention |
| 4-5 | I-32 | 95 | 0.01 | Invention |

It will be understood from the results shown in Table 8 that when the metallocene compounds according to the present invention are applied to the silver halide photographic materials, particularly spectral-sensitized silver halide photographic materials, sensitivity can be increased without increasing fog, and storage stability can be improved.

Accordingly, the metallocene compounds according to the present invention are useful compounds for increasing sensitivity.

While the present invention has been described in detail and with reference to specific embodiments thereof, it is apparent to one skilled in the art that various changes and modifications can be made therein without departing from the spirit and the scope of the present invention.

What is claimed is:

1. A silver halide photographic material comprising a support having thereon at least one silver halide emulsion layer, wherein at least one layer contains at least one metallocene compound represented by the following formula (I):

(I)

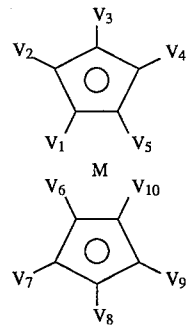

wherein M represents Fe, Ti, V, Cr, Co, Ni, Ru, Os or Pd; and $V_1$, $V_2$, $V_3$, $V_4$, $V_5$, $V_6$, $V_7$, $V_8$, $V_9$, and $V_{10}$ are the same or different and each represents a hydrogen atom, a methyl group, an ethyl group, a carboxymethyl group, a 2-carboxyethyl group, a 3-carboxypropyl group, a 4-carboxybutyl group, a sulfomethyl group, a 2-sulfoethyl group, a 3-sulfopropyl group, a 4-sulfobutyl group, a 3-sulfobutyl group, a 2-hydroxy-3-sulfopropyl group, a 2-cyanoethyl group, a 2-chloroethyl group, a 2-bromoethyl group, a 2-hydroxyethyl group, a 3-hydroxy-propyl group, a hydroxymethyl group, a 2-hydroxyethyl group, a 4-hydroxybutyl group, a 2,4-dihydroxybutyl group, a 2-methoxyethyl group, a 2-ethoxyethyl group, a methoxymethyl group, a 2-ethoxycarbonylethyl group, a methoxycarbonylmethyl group, a 2-methoxyethyl group, a 2-ethoxyethyl group, a 2-phenoxyethyl group, a 2-acetyloxyethyl group, a 2-propionyloxyethyl group, a 2-acetylethyl group, a 3-benzoylpropyl group, a 2-carbamoylethyl group, a 2-morpholinocarbonylethyl group, a sulfamoylmethyl group, a 2-(N,N-dimethylsulfamoyl)ethyl group, a benzyl group, a 2-naphthylethyl group, a 2-(2-pyridyl)ethyl group, an allyl group, a 3-aminopropyl group, a dimethylaminomethyl group, a 3-methylaminopropyl group, a methylthiomethyl group, a 2-methylsulfonylethyl group, a methylsulfinylmethyl group, a 2-acetylaminoethyl group, a acetylaminomethyl group, a trimethylammoniummethyl group, a 2-trimethylhydrazinoethyl group, a methylsulfonylcarbamoylmethyl group, a (2-methoxy)ethoxymethyl group, a phenyl group, a 1-naphthyl group, a p-chlorophenyl group, a 2-pyridyl group, a 2-thiazolyl group, a 4-phenyl-2-thiazolyl group, a carboxyl group, a formyl group, an acetyl group, a benzoyl group, a 3-carboxypropanoyl group, a 3-hydroxypropanoyl group, a chlorine atom, an N-phenylcarbamoyl group, an N-butylcarbamoyl group, a boric acid group, a sulfo group, a hydroxyl group, a methoxy group, a methoxycarbonyl group, an acetyloxy group, or a dimethylamino group, provided that two of $V_1$, $V_2$, $V_3$, $V_4$, $V_5$, $V_6$, $V_7$, $V_8$, $V_9$, and $V_{10}$ may be combined with each other to form a ring; or two or more of the metallocene compounds may be combined together.

2. The silver halide photographic material as claimed in claim 1, wherein M is Fe.

3. The silver halide photographic material as claimed in claim 1, wherein the silver halide photographic material is spectral-sensitized by a spectral sensitizing dye.

4. The silver halide photographic material as claimed in claim 3, wherein the spectral sensitizing dye is represented by the following formulae (XI), (XII) or (XIII):

(XI)

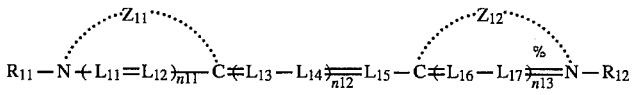

$M_{11}m_{11}$ (XII)

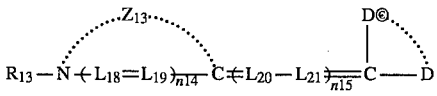

$M_{12}m_{12}$ (XIII)

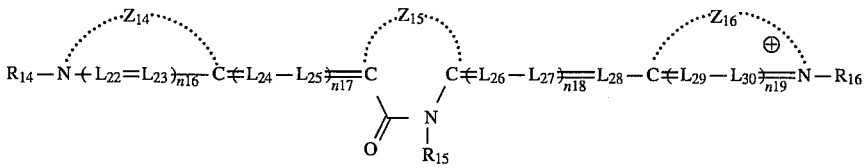

$M_{13}m_{13}$ wherein $Z_{11}$, $Z_{12}$, $Z_{13}$, $Z_{14}$, $Z_{15}$ and $Z_{16}$ are the same or different and each represents an atomic group necessary for forming a 5-membered or 6-membered nitrogen-containing ring;

D and D' are the same or different and each represents an atomic group necessary for forming a non-cyclic or cyclic acidic nucleus;

$R_{11}$, $R_{12}$, $R_{13}$, $R_{14}$ and $R_{16}$ are the same or different and each represents an alkyl group;

$R_{15}$ represents an alkyl group, an aryl group or a heterocyclic group;

$L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$ and $L_{30}$ are the same or different and each represents a methine group;

$M_{11}$, $M_{12}$ and $M_{13}$ are the same or different and each represents a counter ion for neutralizing charge;

$m_{11}$, $m_{12}$ and $m_{13}$ are the same or different and each represents a number of 0 or more necessary for neutralizing the molecular charge;

$n_{11}$, $n_{13}$, $n_{14}$, $n_{16}$ and $n_{19}$ are the same or different and each represents 0 or 1; and $n_{12}$, $n_{15}$, $n_{17}$ and $n_{18}$ are the same or different and each represents an integer of 0 or more.

5. The silver halide photographic material as claimed in claim 4, wherein the compound represented by formula (XI) is a compound represented by the following formula (XIV):

(XIV)

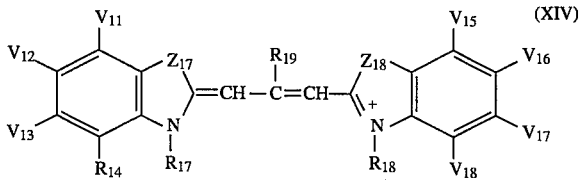

$M_{14}m_{14}$ wherein $Z_{17}$ and $Z_{18}$ are the same or different and each represents a sulfur atom or a selenium atom;

$R_{17}$ and $R_{18}$ are the same or different and each represents an alkyl group;

$R_{19}$, $V_{11}$, $V_{12}$, $V_{13}$, $V_{14}$, $V_{15}$, $V_{16}$, $V_{17}$ and $V_{18}$ are the same or different and each represent a hydrogen atom or a monovalent substituent, and adjacent two of $V_{11}$, $V_{12}$, $V_{13}$, $V_{14}$, $V_{15}$, $V_{16}$, $V_{17}$ and $V_{18}$ may be combined with each other to form a condensed ring;

$M_{14}$ represents a counter ion for neutralizing charge; and $m_{14}$ represents a number of 0 or more necessary for neutralizing the molecular charge.

6. The silver halide photographic material as claimed in claim 1, wherein the metallocene compound represented by formula (I) is used in an amount of from $1\times10^{-6}$ to $5\times10^{-1}$ mol per mol of silver halide.

7. The silver halide photographic material as claimed in claim 3, wherein the spectral sensitizing dye is used in an amount of from $4\times10^{-8}$ to $8\times10^{-2}$ mol per mol of silver halide.

8. A silver halide photographic material as claimed in claim 1, wherein $V_1$ to $V_{10}$ are each a hydrogen atom, a carboxyl group, a sulfo group, a phenyl group or an ethyl group.

9. A silver halide photographic material as claimed in claim 1, wherein $V_1$ to $V_{10}$ are each a hydrogen atom.

* * * * *